US008490538B2

(12) United States Patent
Tawil

(10) Patent No.: US 8,490,538 B2
(45) Date of Patent: Jul. 23, 2013

(54) SYSTEM FOR PROTECTING SURFACES AGAINST EXPLOSIONS

(76) Inventor: Jack Joseph Tawil, Merritt Island, FL (US)

( * ) Notice: Subject to any disclaimer, the term of this patent is extended or adjusted under 35 U.S.C. 154(b) by 225 days.

(21) Appl. No.: 13/011,810

(22) Filed: Jan. 21, 2011

(65) Prior Publication Data

US 2012/0152102 A1 Jun. 21, 2012

Related U.S. Application Data

(60) Provisional application No. 61/297,261, filed on Jan. 21, 2010, provisional application No. 61/321,960, filed on Apr. 8, 2010.

(51) Int. Cl.
*F41H 11/00* (2006.01)

(52) U.S. Cl.
USPC ..... 89/36.17; 89/902; 89/1.11

(58) Field of Classification Search
USPC ..... 89/1.11, 36.17, 902
See application file for complete search history.

(56) References Cited

U.S. PATENT DOCUMENTS

| | | | | |
|---|---|---|---|---|
| 1,195,042 | A * | 8/1916 | Leon | 114/20.1 |
| 4,194,431 | A | 3/1980 | Markus et al. | |
| 5,001,984 | A * | 3/1991 | Jones et al. | 102/418 |
| 5,012,742 | A * | 5/1991 | Jones | 102/418 |
| 6,119,574 | A * | 9/2000 | Burky et al. | 169/47 |
| 6,327,955 | B1 * | 12/2001 | Kerdraon et al. | 89/36.17 |
| 6,782,793 | B1 | 8/2004 | Lloyd | |
| 6,901,839 | B2 * | 6/2005 | Edberg et al. | 89/36.17 |
| 7,077,049 | B2 * | 7/2006 | Shumov et al. | 89/36.17 |
| 7,114,428 | B1 | 10/2006 | Lloyd | |
| 7,202,809 | B1 * | 4/2007 | Schade et al. | 342/67 |
| 7,387,060 | B1 * | 6/2008 | Sanford | 89/1.11 |
| 7,424,845 | B2 * | 9/2008 | Zank et al. | 89/36.17 |
| 7,680,599 | B1 | 3/2010 | Steadman et al. | |
| 7,717,023 | B2 | 5/2010 | Pereira et al. | |
| 7,870,813 | B2 | 1/2011 | Ham et al. | |
| 7,878,103 | B2 * | 2/2011 | Imholt et al. | 89/36.08 |
| 7,954,411 | B2 * | 6/2011 | Odhner et al. | 89/1.11 |
| 2002/0152881 | A1 * | 10/2002 | Stevens et al. | 89/36.17 |
| 2007/0180983 | A1 * | 8/2007 | Farinella et al. | 89/36.07 |
| 2008/0105111 | A1 * | 5/2008 | Costanza et al. | 89/1.11 |
| 2010/0282057 | A1 * | 11/2010 | Rapp et al. | 89/14.3 |
| 2010/0294116 | A1 * | 11/2010 | Odhner et al. | 89/1.11 |
| 2010/0313741 | A1 * | 12/2010 | Smogitel | 89/1.11 |
| 2011/0162518 | A1 * | 7/2011 | Brill et al. | 89/36.17 |
| 2012/0239247 | A1 * | 9/2012 | Eridon | 701/36 |
| 2012/0312149 | A1 * | 12/2012 | Marscher et al. | 89/1.11 |

* cited by examiner

*Primary Examiner* — Daniel J Troy
*Assistant Examiner* — Derrick Morgan

(57) ABSTRACT

A system for mitigating the effects of an unexpected explosion against a surface is described and claimed. This invention comprises at least one containment vessel containing explosive material fitted with a detonator; and at least one sensing device that can ignite the detonator; or, in another embodiment, a computer interposed between sensing devices and a plurality of detonators to optimize the response. Because transient voltages from a high-voltage firing system can accidentally ignite the detonators, a safety switch driven by an EBW detonator is interposed between the firing system and the counter-explosive devices. The explosive force generated by the current invention attenuates the shockwave and deflects the shrapnel from the unexpected explosion. In various embodiments, this counter-explosive device can be adapted to protect a multiplicity of surface types including exterior vehicle surfaces, building facades, bridges, embassies and military checkpoints and guard stations.

20 Claims, 17 Drawing Sheets

(a)

(b)

(a)

(b)

(c)

(a)

(b)

SYSTEM FOR PROTECTING SURFACES AGAINST EXPLOSIONS

CROSS-REFERENCE TO RELATED APPLICATIONS

Figure 1:
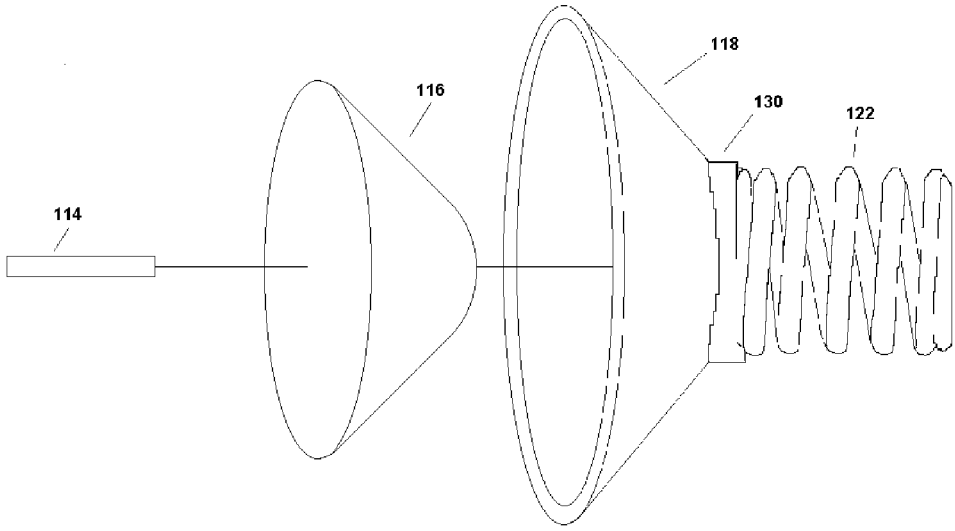

This application claims the benefit of provisional patent applications 61/297,261, filed Jan. 21, 2010 and 61/321,960, filed Apr. 8, 2010 by the present inventor.

FEDERALLY SPONSORED RESEARCH

Not Applicable

SEQUENCE LISTING OR PROGRAM

Not Applicable

BACKGROUND OF THE INVENTION

1. Field of Invention

This invention relates to protecting surfaces against unexpected explosions, and specifically, countering an external explosion with a counter-explosion.

2. Prior Art

Although this invention has wider scope, its original motivation was to provide protection to military vehicles and their occupants from roadside bombs, also known as improvised explosive devices or IEDs. The problem of IEDs first became apparent in Iraq in 2002, when IEDs took the lives of four coalition members; the lethality of these devices has been growing ever since. In 2010, 368 coalition troops were killed by IEDs, and the total for ten years of war in Iraq and Afghanistan is 953. The number of non-lethal casualties is several times larger. [For ease of reference, the term IED will be used throughout this specification, with the understanding that it may refer to any bomb or other explosive device, and such term is not intended to be limiting in any manner.]

In early 2006, an organization called the Joint IED Defeat Organization, or JIEDDO, was formed to deal specifically with the problem of the IED. Thus far, JIEDDO has spent approximately $20 billion in search of a solution, much of it on sponsored research. While JIEDDO has had many successes, solving the IED problem remains a high priority for the military.

The IED problem has been attacked on many fronts. One of the most effective has been improvement in armor, including the development of active armor. Several patents issued to Zank et al., including U.S. Pat. No. 7,424,845, illustrate this technology. Other patents pertaining to ballistic (active) armor include U.S. Pat. No. 4,194,431 issued to Markus et al., and U.S. Pat. Nos. 6,782,793 and 7,114,428 issued to Lloyd. Active armor comprises two layers of armor between which small shaped charges are positioned. When an object strikes the outer layer with significant force, the charges are ignited to provide a counterforce and protect the inner armored layer. The main disadvantages with active armor are the substantial weight added to a vehicle and its increased acquisition and operating costs. The added weight may also render the vehicle less agile and less mission-capable.

Another approach to defeating the IED is to detect the device before it can go off, and then to remove or discharge it. U.S. Pat. No. 7,680,599 issued to Steadman, et al. seeks to detect the actual emplacement of IEDs utilizing sensors that have been pre-installed. A reporting signal is relayed to the base station via other sensors to elicit a response. U.S. Pat. No. 7,717,023, issued to Pereira, et al., "detects the IED . . . [by]: detecting internal battery components; detecting magnetic signature(s) of the IED; detecting a characteristic energy spectrum of the IED; and/or detecting characteristic chemical signatures of the device(s)." However, prior detection has been only partially successful.

IEDs may be set off by a remote signaling device, such as a cell phone Jamming the signaling device has proven to be a successful technique. For example, U.S. Pat. No. 7,870,813 issued to Ham, et al. seeks to jam electromagnetic signals by broadcasting electromagnetic waves over a suspected area. Mine rollers can be used to defeat pressure-sensitive explosive devices. Intelligence is another effective approach. For example, troops seek to gain the confidence of locals whom they hope will disclose the placement of IEDs.

However, no prior art has been found regarding the current invention, which utilizes counter-explosions to defeat the IED. A counter-explosion can offer the power and the quick response time required to attenuate an IED's shockwave and to repel or deflect its shrapnel. Perhaps one way to account for the apparent lack of prior art is to observe that sufficiently fast components for detecting and responding to an IED attack in the short time available have only come onto the market relatively recently.

OBJECTS AND ADVANTAGES

Accordingly, the objects and advantages of the Surface Protective System are: [0014] (a) to provide a protective system that offers a high success rate in defeating an unexpected external explosion; [0015] (b) to reduce military casualties and deaths caused by IEDs; [0016] (c) to provide the capability to retrofit existing military vehicles; [0017] (d) to reduce the weight of armored vehicles by permitting lighter armor to be used for protection, thereby making vehicles faster and more agile; [0018] (e) to reduce the powering requirements of armored vehicles as a result of being lighter; [0019] (f) to reduce the life-cycle costs of military vehicles; and [0020] (g) to increase the stability of armored vehicles by lowering their center of gravity. [0021] Further objects and advantages are to provide a protective system that can be installed on: buildings, such as embassies, to protect them from an external blast; infrastructure, such as the structural members of bridges; public transport vehicles such as railway cars and buses; and security stations at the entrance to military bases, other key points of entry and to military barracks.

SUMMARY

The basic invention is a counter-explosive device (CED) designed to protect external surfaces from unexpected explosions. It accomplishes this by means of a controlled directional counter-explosion that attenuates the shockwave and the effects of shrapnel from an external explosion.

The CED comprises a containment vessel, explosive material and a detonator. The size and shape of the containment vessel determine the quantity of explosive material that the vessel can contain and the extent to which the counter-explosion generated by the CED is diffused.

While this invention has wide application, the preferred embodiment described herein is a Vehicle Protective System (VPS) designed to protect military vehicles from IEDs and other explosive devices, including projectiles such as rocket-propelled grenades (RPGs). The VPS comprises various embodiments of the CED technology, depending, in part, on the vehicle component to be protected.

A key component of this invention is a high-speed, normally open, electro-mechanical safety switch driven by an exploding-bridgewire (EBW) detonator. Up to now, a vehicle could be outfitted with multiple CEDs, but the vehicle would be unsafe for travel because the high-voltage energy-storage capacitors could at any time discharge accidentally due to transient voltages, causing a capacitor to ignite an EBW detonator that is inserted into a high-explosive charge. This hazard increases significantly if the system is deployed on a moving vehicle. Delaying the charging of the capacitors until an attack has been detected would not allow sufficient response time. With the EBW safety switch inserted between the charged capacitors and the EBW detonators, an accidental discharge of the capacitors could not ignite a detonator unless an IED attack was already underway and had been detected.

CEDs can be mounted directly onto the external surfaces of a vehicle, within housings that are recessed into a vehicle's surfaces, or contained within a separate housing that can hold a plurality of CEDs. This last configuration is called a CED array and can be mounted on a vehicle's surface.

In a preferred embodiment of this invention, the VPS comprises: a) a plurality of sensors; b) a multi-channel A/D converter; c) a computer; d) at least one fire control unit; e) at least one EBW safety switch; (f) at least one firing module; and g) a plurality of CEDs and CED arrays.

The underbody of a vehicle is especially vulnerable to an explosion originating from underneath the vehicle, because the explosion tends to be partially contained between the vehicle and the ground surface, giving the explosion greater destructive force. A further embodiment of this invention includes a vehicle underbody shield that, when combined with a sensor system and arrays of CEDs, can offer significantly greater vehicle protection than current technology. It will be further appreciated that hereafter in the specification and claims, terms which relate to direction, such as "above", "below", "upward", "downward", "upper", "lower", etc., refer to a typical configuration of the underbody when attached to the vehicle and the vehicle is in its upright position, with the vertex of the two panels forming the V-shaped underbody pointing towards the ground.

DRAWINGS

FIG. 1. A CED for retrofitting to vehicles, comprising a detonator, cake of high explosive, containment vessel, collar and coil-spring shock absorber FIG. 2. A CED assembly recessed into a cylinder housing and mounted in vehicle panel FIG. 3. Schematic of a Vehicle Protective System FIG. 4. Two stacked, offset, radial housings for photodiodes FIG. 5. A CED array with three CEDs installed in a shallow-profile housing FIG. 6. (a) Positioning CED arrays on the vehicle underbody, end view; (b) positioning CED arrays on the vehicle underbody, isometric view FIG. 7. CED embodiments for vehicle frame/chassis and suspension FIG. 8. Location and coverage of pressure sensors and photodiode assemblies FIG. 9. (a) Cross-sectional front view of the exploding-bridgewire safety switch; (b) top view of the lower contact holder and contacts; and (c) mounting of the blast shield FIG. 10*a*. Schematic for computer-optimized response, showing multiple safety switches FIG. 10*b*. Schematic of a subsystem for computer-optimized response; safety switch with multiple independent high-voltage circuits controls individual or small groups of CEDS FIG. 11. Flow diagram for a computer-optimized Vehicle Protective System FIG. 12. Response sequence and elapsed times for major components of the VPS FIG. 13. (a) CED with locking cap; (b) CED with alternative coil-spring shock absorber embodiment FIG. 14. Coil spring shown with mounting bracket, lugs and clamp FIG. 15. Schematic for Vehicle Protective System with no computer

REFERENCE NUMERALS

100—sensors 102—multi-channel A/D converter 104—computer 106—signal conditioner 108—fire control unit 109—relay 110—firing module 111—ignition module 112—safety switch 114—exploding-bridgewire (EBW) detonator 116—explosive material 118—containment vessel 120—counter-explosive device (CED) 120'—elliptically-shaped CED 122—coil-spring shock absorber 124—locking mechanism 126—slot for lock 128—containment housing cap 130—collar 136—bracket 138—lug 140—metal plate 142—vehicle surface 144—pressure clamp 146—threaded bolt 150—CED canister 152—cylinder sleeve 154—piston, CED 156—piston ring 158—air pocket 160—plate with circular cutout 162—shear pin 164—containment vessel cap 166—access hole 168—shrapnel 170—detonator holder 172—exploding bridgewire detonator 174—washer 176—blast shield 178—cylinder head 180—exhaust port 182—combustion chamber 184—cylinder sleeve 186—piston boot 188—piston, EBW switch 190—ceramic annulus 192—steel annulus or plate 194—switch housing 196—high-voltage terminal 198—low-voltage terminal 200—upper contact holder 202—lower contact holder 204—primary upper contact 206—primary lower contact 208—secondary upper contact 210—secondary lower contact 212—dielectric plate 214—steel annulus 216—dense foam cushion 218—switch-housing base 220—keyway 222—key 224—nylon socket cap screw 226—PTFE insulator 228—detonator leads 230—PTFE piston cap 240—radial housing 302—CED array housing 310—V-shaped vehicle underbody 312—CED array 314—Security vault 316—Pressure sensor 318—Security vault mount 324—Photodiode assembly 326—Double-CED array 340—Beam frame 344—Asymmetric array housing 346—Angle mount

DETAILED DESCRIPTION

Preferred Embodiment

FIGS. 1-15

The present invention is a Surface Protective System (SPS). It can be applied to protect virtually any surface from unexpected external explosions, including vehicles. It can be retrofitted to existing vehicles to reduce their vulnerability and to increase the survivability of its occupants. More specifically, the current invention can be applied to a variety of military vehicles, ranging from Humvees (HMMWVs) and tractor-trailers to mine-resistant ambush-protected vehicles (MRAPs).

The principle underlying this invention is that the response time and force of a controlled counter-explosion is potentially sufficient to attenuate the shockwave and the effects of shrapnel from an IED. The basic component of this invention is the counter-explosive device (CED); the explosive device is an old technology, but here it is adapted to a new use. An example of a CED suitable for retrofitting is shown in FIG. 1. The CED consists of a cake of high-explosive material (116), such as C-4, within a containment vessel (118), and an exploding-bridgewire detonator (114). The basic form of the containment vessel is a cone that terminates in a hemisphere at the smaller end. The vessel is fabricated from material of sufficient strength to contain the rapidly expanding gases resulting from the detonation of the explosive material, which is inserted into the closed end of the containment vessel. The taper of the cone of the containment vessel controls the scope and intensity of the CED's explosive force: a narrower taper will produce a less diffused, more intense counter-blast, while a relatively wide taper will result in a more highly dispersed, less intense counter-blast. The length of the cone as well as the shape of the charge can also affect the dispersion pattern.

The EBW detonator is matched to the size and composition of the high-explosive cake. The preferred explosive is C-4 because it is stable, easily pressed into an empty, shaped-charge containment vessel and has a relatively high velocity of detonation (25,000 fps). C-4 is readily available from commercial sources and at relatively low cost. The containment vessel is fabricated from a metal that provides the best combination of strength, weight and cost at the time of acquisition. Weight is a concern because, for military applications, lighter vehicles are usually more mission-capable.

Figure 2:
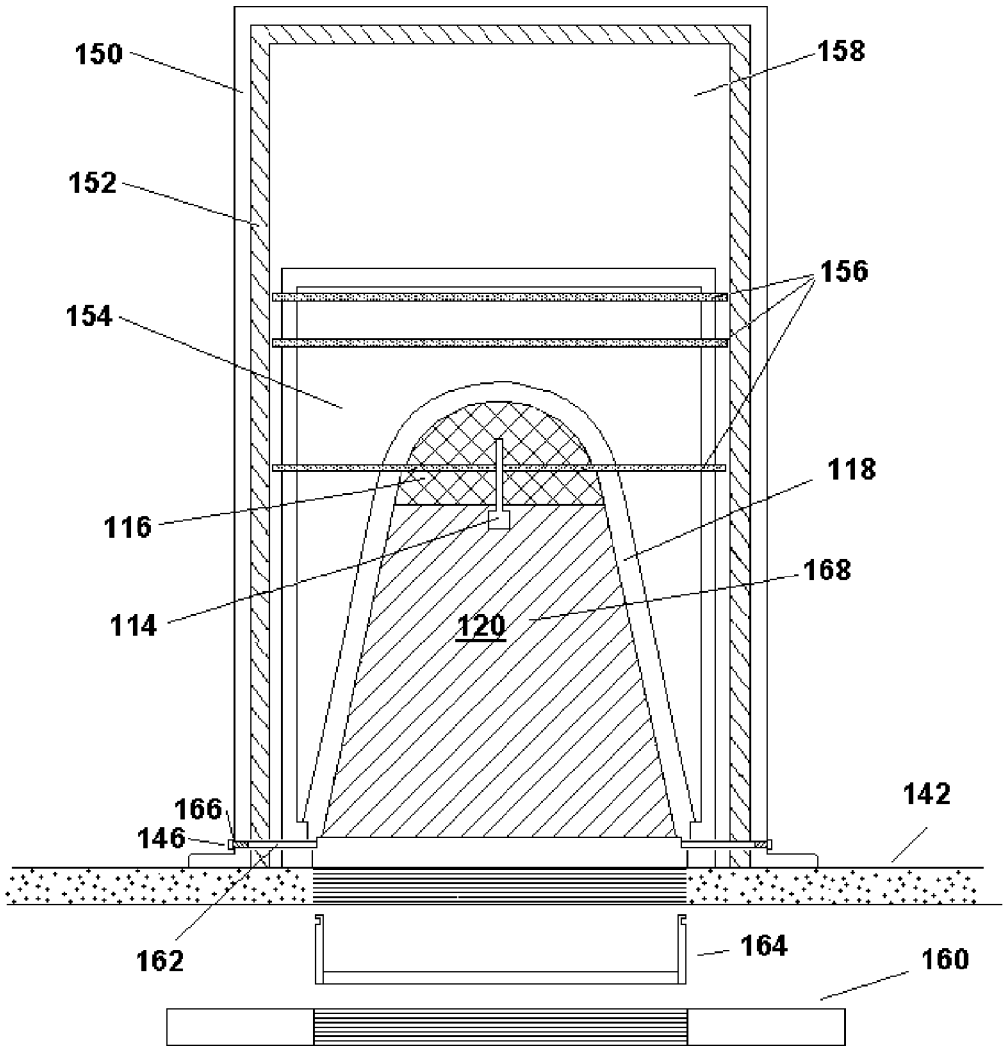

The preferred embodiment incorporates the CED into a shock-absorbing canister, shown in FIG. 2. It is especially suitable for new vehicles. The CEDs are inserted through a receptacle hole in the vehicle's surface (142) and into a recessed canister (150) that is fastened to the vehicle's interior surface, or it may be to the front panel of a separate container that is mounted on a vehicle's exterior and which may contain a plurality of CED assemblies. In the preferred embodiment, a cylinder sleeve (152) and the canister are of unitary construction and comprise the cylinder. A piston (154) optionally fitted with oil rings and a compression ring (156) compresses a pocket of air (158) to absorb the shock from the recoil of the CED (120). The manner in which the closed end of the containment vessel (118) engages the bottom of the piston includes simple contact, attached together or of unitary construction. In the preferred embodiment, the piston and containment vessel (118) are of unitary construction. A metal plate (160) with an annular cutout, whose diameter is the same as the inside diameter of the open end of the containment vessel, secures the containment vessel in place and inhibits tampering. A plurality of shear pins (162) secures the containment vessel, the piston, the cylinder sleeve, the cylinder canister and the containment vessel cap (164) and are designed to shear when the CED is detonated. The shear pins and cap also keep the explosive material and detonating device secure from unauthorized personnel. Exterior access holes (166) facilitate driving the pins out for replacement. A threaded bolt (146) that screws into the access hole is of unitary construction with the shear pin to facilitate removal of the latter. The cap, with the same outside diameter as the vessel's inside diameter, fits inside the containment vessel and holds the shrapnel (168) in place. The closed end of the container is molded on the inside so that when the plastic explosive is pressed into it, the explosive assumes an optimal shape. A detonator (114) is then inserted into the explosive material. In all embodiments, the CED assembly is constructed of materials able to withstand the shock, heat and pressure emanating from the explosion, except when the assemblies are disposable to conserve on weight.

Figure 3:
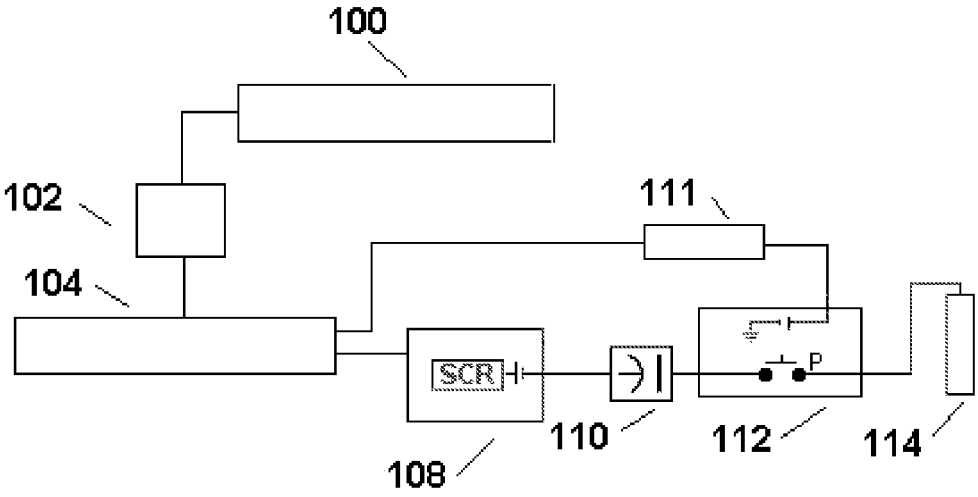

FIG. 3 is a schematic of the preferred embodiment of a Vehicle Protective System (VPS), comprising: sensing devices (100), multi-channel A/D converter (102), computer (104), fire control unit (108), firing module (110), ignition module (111), safety switch (112) driven by an exploding-bridgewire (EBW) detonator, and another EBW detonator (114) that is installed in a CED. All of these components must be able to operate effectively in a hostile environment and be able to withstand various shocks that a military vehicle is likely to experience—apart from a catastrophic explosion, which the current invention is designed to prevent.

The preferred embodiment uses a plurality of both pressure sensors and photodiodes (light sensors). Both must have very rapid response times. Pressure sensors and photodiodes are commercially available with response times of about one microsecond and one nanosecond, respectively.

Photodiodes can be used synergistically with pressure sensors. Because pressure sensors cannot detect an IED attack until the shockwave arrives at the sensor location, the alarm it provides comes late in the response process, but it precisely locates the shockwave. The opposite is true with photodiodes: light from the explosion travels quickly (300,000 km/sec), but there is some ambiguity regarding the exact origin of the IED attack Timing of the response to the attack can be critical, especially when the system is responding to an under-the-vehicle attack in which the counter-explosion will be at an angle to the IED blast, and so must be timed to intercept the shockwave. However, when used in combination, photodiodes and pressure sensors can be highly effective. The photodiodes can provide advanced warning so that the Vehicle Protective System can arm itself prior to the arrival of the shockwave; and when the shockwave hits the pressure sensors, the system is ready to respond with its counter-explosions. Pressure sensors must be able to detect an explosion as close as one foot away or even less from the vehicle, transmit a signal, and, preferably, survive the explosion.

Figure 4:
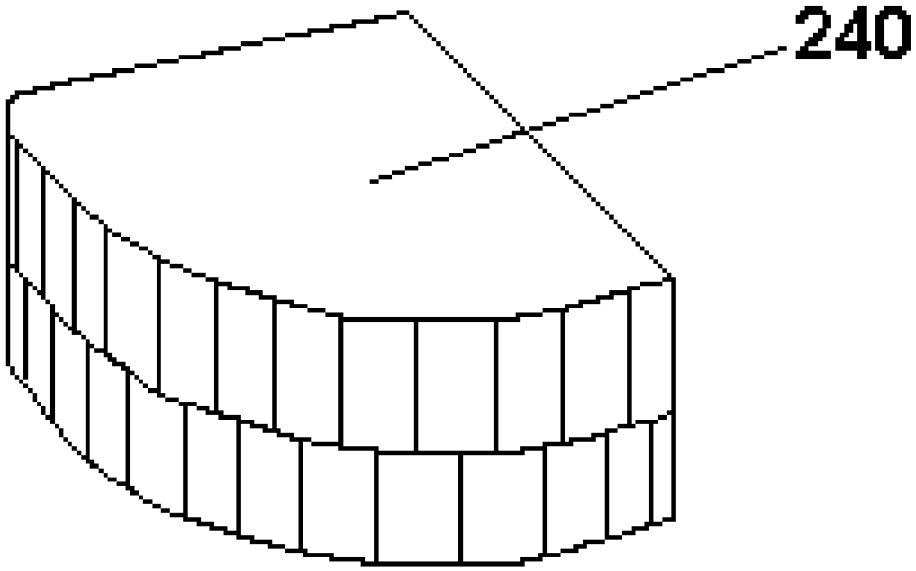

The photodiodes are installed in sealed radial housings (240), which can be stacked and offset, as shown in FIG. 4, to achieve greater resolution of location. In the preferred embodiment, they are recessed into compartments and protected by blast-resistant glass lenses, which insulate and protect the photodiodes from intense heat and fragments. There are also light filters between the glass and the photodiodes to protect the latter from light energy overload. One 90.degree. housing containing 11 photodiodes can provide a resolution of about eight degrees. When two such housings are stacked and offset, the resolution can be approximately doubled to four degrees. However, by increasing the radius of the housing, the same resolution can be achieved without stacking, but with more compartments.

At least two photodiode housings must be placed at separated locations on the vehicle so that the IED's origin can be triangulated. In the preferred embodiment, to protect the vehicle's sides, a radial housing is located at each of the vehicle's corners, with each housing providing coverage of 270.degree. To adequately protect the vehicle underbody, a radial housing providing coverage of 90.degree. and oriented inward is installed at each of the vehicle's four corners. They should be positioned as close to the ground as feasible, so placing them close to a wheel will offer more protection against objects protruding from the ground.

Figure 5:
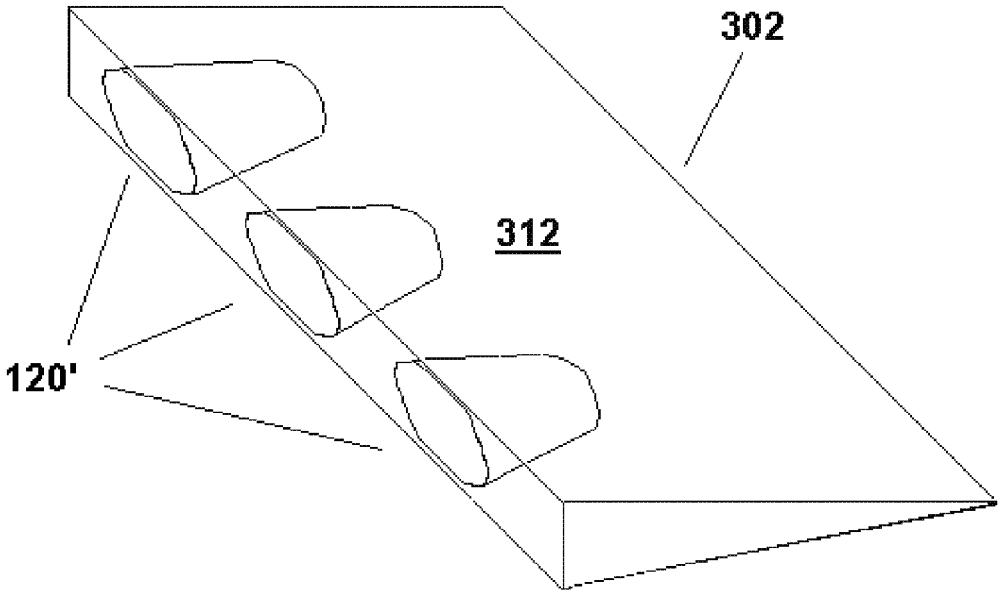

The preferred embodiment employs several different types of housings and mountings for maximum effectiveness in protecting a vehicle's surfaces. FIG. 5 shows a CED array (312), comprised of three CEDs (120') that are elliptically shaped to reduce their top-to-bottom profile; an array may contain one or several of these low-profile CEDs. The CEDs are installed in a shallow-angled, blast-resistant housing (302), which, in the preferred embodiment, is a triangular prism. Each CED is fitted with an elliptically shaped coil spring that is mounted inside the array housing and that acts as a shock absorber.

The underbody of a vehicle is potentially its most vulnerable surface, given that a normally configured vehicle with a flat floor panel will tend to contain an IED explosion from directly beneath it, giving the explosion greater destructive force. The explosion source also is likely to be closer to the vehicle, giving the explosion greater impact. In the preferred embodiment of this invention shown in FIG. 6, a vehicle's underbody (310) has a V shape to deflect up and away an explosion originating from beneath it. To provide adequate response time, it may be necessary to elevate the vehicle underbody up to two feet above ground level. In new construction, the V underbody will be integral with the body and be elevated to the appropriate height; in retrofits, the vehicle body may be attached to a V underbody shield and then elevated.

Figure 6:
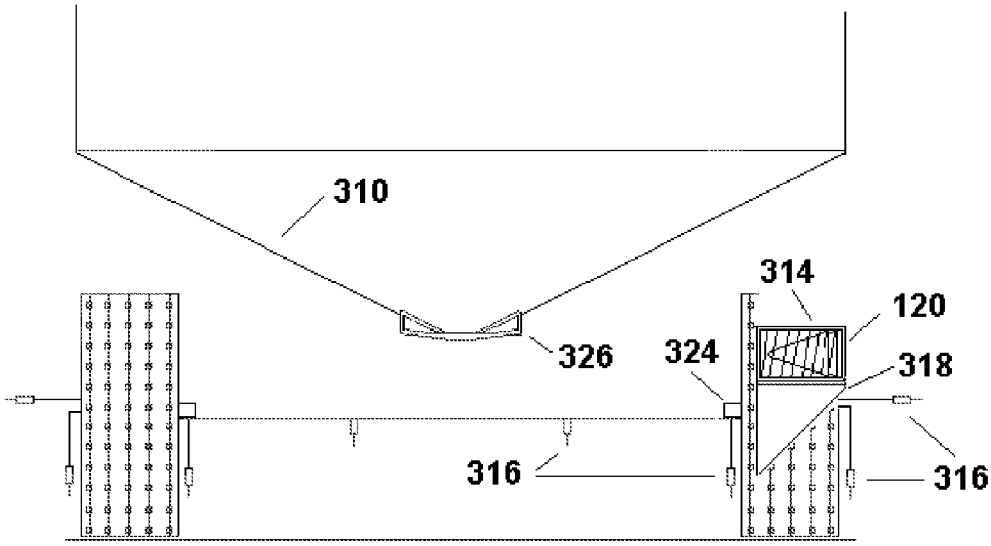
Figure 6:
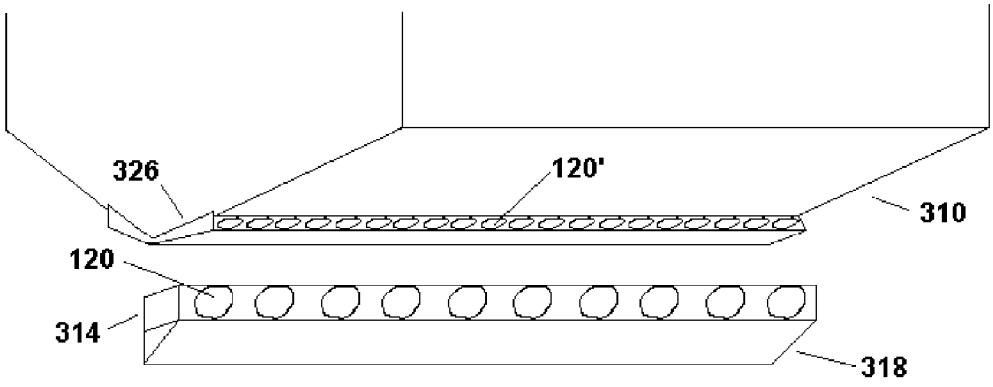

FIG. 6 shows the positioning of CED arrays and other hardware to protect the vehicle underbody. An armored double-CED array (326) protects the base of the underbody at its V, formed by two flat panels. The double-CED array is formed from two CED arrays positioned and combined back edge-to-back edge and angled to conform to the vertex of the underbody's two V panels, as shown in panel (a). It mounts into a recessed area within the V and is heavily armored so as to be highly resistant to a major explosion from directly beneath it. This unit is similar to the one shown in FIG. 5, except that it is more heavily armored, contains more CEDs and has two opposite-facing arrays that protect both sides of the underbody. Depending upon the angle of the underbody, its width and its elevation off the ground, it may be necessary to position an additional array parallel to the double-CED array, and situate it between the double-CED array and the outer edge of the underbody sides. This additional array will ensure that the counter-blast from the CEDs arrives immediately before the shockwave from an IED attack directly below, thereby redirecting the IED blast upward, outward and away from the vehicle. If the CED arrays on the base plate are detonated, the outer arrays, because of their low-profile, present considerably less resistance to the blast and are therefore less vulnerable.

The CEDs (120) that protect the vehicle's sides are mounted inside an armored security vault (314), which is about 18 inches above ground level or less. The security vault itself is mounted on an explosion-resistant mounting rail (318) designed to deflect a ground-borne explosion around it. Other components of the system are also shown in panel (a), including pressure sensors (316) and the photodiode assemblies (324). The pressure sensors around the wheels are positioned just a few inches above the ground in order to get a quick reading of an IED exploding under the vehicle wheel. The pressure sensors along the sides of the vehicle are positioned about 18 inches above ground or less and extend outward about 10" from the side of the vehicle. They are placed to protect the vehicle sides. Another view of the CED arrays is shown in FIG. 6*b*.

Figure 7:
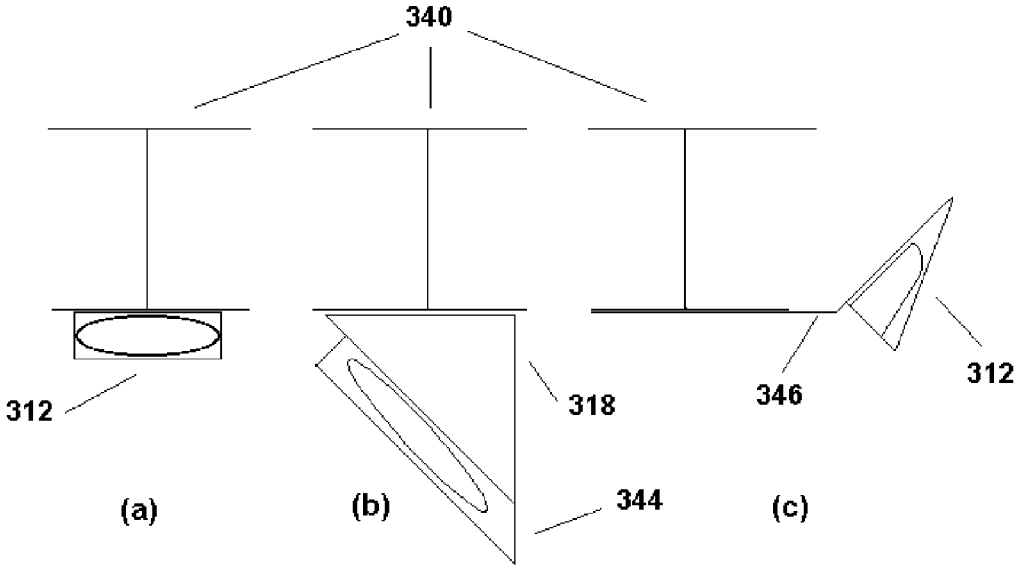

Some additional embodiments of CEDs that can be employed to protect the vehicle frame and suspension components are shown in FIG. 7 for vehicles with a beam frame (340). In panel (a), low-profile CED arrays (312) are installed along the bottom of the beam. Each array is a shallow-angled triangular prism (302 in FIG. 5) containing a single CED with an elliptical cross-section. To minimize dispersion of the blast, containment vessels with non-tapered sides are preferred. Depending upon the elevation of the vehicle frame, arrays are positioned along the beam and spaced about a foot apart. When detonated, the explosive force of the CEDs is directed parallel to and along the bottom of the beam, attenuating the shockwave and the effects of shrapnel from any explosion originating from below. The low angle of each array minimizes the effect of the blast from the array behind it.

The configuration in panel FIG. 6*b* shows a low-profile single-CED that is mounted in an asymmetric array housing (344), which is itself installed on a mount (318) similar to the one used for the security vault shown in FIG. 6*a*. The arrays are positioned every foot or so, again depending on the elevation of the vehicle frame. The sharp edge facing the ground is to deflect around the beam frame an explosion originating from below. Finally, the embodiment in FIG. 6*c* shows a CED array (312) attached to an angled mount (346) that is itself attached to the beam frame. The containment vessels have a relatively wide taper and are oriented toward the ground and facing outward from the vehicle sides.

Steering and suspension components can be protected using similar methods. In one embodiment, these components are protected from explosions originating from below by enclosing them to the extent possible within an open-top vault. The arrangement is similar to that shown in FIG. 6*b*, with the CED arrays mounted in the same way.

If a vehicle can be lifted off of the ground immediately prior to receiving an external blast from an IED, rocket-propelled grenade (RPG) or other source not under the vehicle, then the vehicle will offer less lateral resistance to a blast and is therefore less likely to suffer damage to itself and/or injury to its secured occupants. On the other hand, a vehicle resting on the ground is highly resistant to lateral forces, and therefore its side panels are more likely to be deformed or breached. However, to the extent that the systems described above prove successful in protecting a vehicle's surfaces, mitigating the effects of an attack via this lift procedure may be necessary only in situations in which the computer determines that the power from the impending blast is sufficiently great that it will overpower the counterblast.

To implement this defense, CEDs are mounted near each corner of the vehicle, with the open ends of the containment vessels facing towards the ground. The closer these CEDs are to the ground, the greater and quicker is the lift they will provide. However, when positioning these CEDs, consideration should be given to vehicle ground clearance and the potential risk to vehicle wheels and other components.

The vehicle wheels are problematic in that when an IED explodes with a wheel directly over it, the impact of the explosion will precede any warning from a sensor. However, the V-shaped underbody (see FIG. 6*a*) provides extra distance between the wheel and the underbody. The pressure sensors (316) located on each side of the wheel just a few inches above ground level will provide early warning. Once these sensors sense the shockwave, a response can be delivered in less than 30 microseconds. In that time period, the shockwave will have traveled less than 10 inches. It is likely that the IED explosion will blow the wheel off the vehicle, so setting off the four CED lifters and the double-array (326) mounted along the vertex of the underbody should provide sufficient protection, as the wheel will be moving much slower than the shockwave. Furthermore, setting off the four CED lifters will counter the tendency for the IED to flip the vehicle, especially if the wheel is blown off. If wheels tend to remain with the vehicle, they can be blown off with explosive bolts at the connection points in combination with a CED mounted on the suspension facing outwards.

DETECTION The use of detection devices is a key element of the current invention. In the preferred embodiment, piezoelectric pressure sensors with a one-microsecond response time are connected physically or wirelessly to a computerized monitoring system. These sensors are strategically placed on the external surfaces to be protected. As was shown in FIG. 4, photodiodes can be installed in sealed radial housings (240) that can be stacked and offset, if necessary, to achieve greater accuracy in locating the IED blast.

Figure 8:
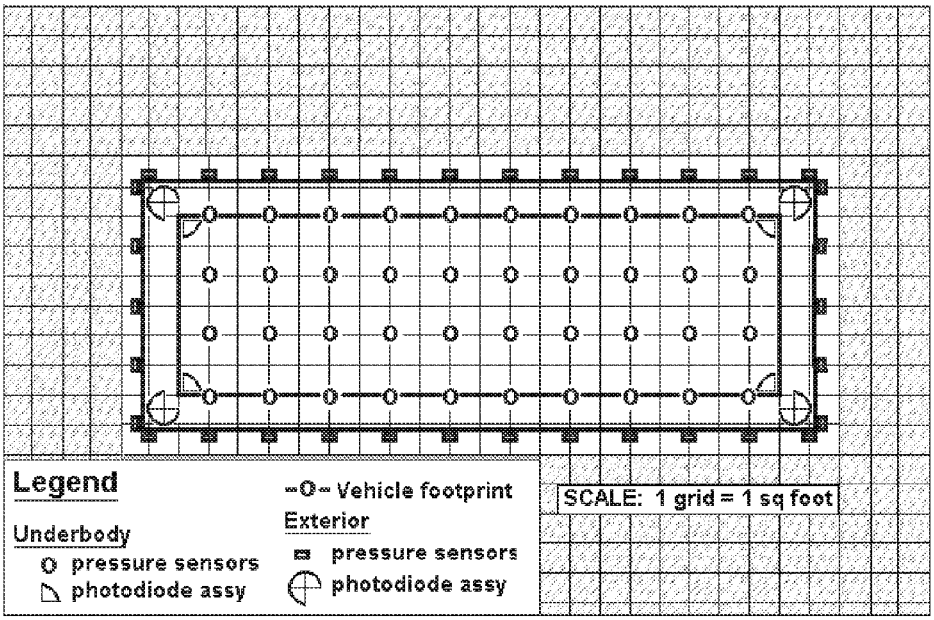

FIG. 8 shows the placement of pressure sensors (hollow circles and black rectangles) and photodiode assemblies (partial circles) on a vehicle (inner rectangle) that is 6' wide by 20' long (scale: 1 grid unit=1 sq ft). This inner rectangle represents the vehicle footprint, and the hollow circles on and within it show the placement of pressure sensors mounted underneath the vehicle. The distance between the rows of these sensors depends on the angle of the V underbody—the higher a point on the underbody is from the ground, the more separated the lengthwise rows of pressure sensors beneath it can be.

The small solid rectangles around the outer rectangle show the placement of pressure sensors mounted about one to 1½' above ground level and extended about 10" beyond the vehicle's vertical panels. These locations will provide adequate warning time. The ¾-circles represent 270.degree. photodiode assemblies; they are mounted on the exterior corners of the vehicle also about 1½' above ground, and facing outward. The quarter-circles are 90.degree. photodiode assemblies mounted underneath the vehicle, each assembly near an inside wheel and facing inward. The shaded squares in the figure are the areas monitored by photodiodes only. Both photodiodes and pressure sensors monitor the white squares under and around the vehicle. Together they provide complete coverage of the area underneath and surrounding the vehicle, except for the areas directly under the wheels. However, as was discussed earlier, the two pressure sensors on either side of each wheel can be used in mitigating the effects of underwheel explosions.

RESPONSE TIMES Pressure sensors must be positioned at a sufficient distance from the vehicle's surface to allow a response before the IED shockwave can impact the surface. The shockwave from a C-4 explosion travels nearly a foot in 36 microseconds; the shockwave from an ANFO (ammonium nitrate and fuel oil mixture) explosion travels little more than 4.5" over the same time span. Table 1 below shows the velocity of detonation (VOD) and the distance that a shockwave travels in 24 and 36 microseconds for selected high explosives. Commercially available components used in the embodiments of the current invention plus the expected speed of the EBW safety switch suggest that a response time between 24 and 36 microseconds is attainable.

Selected explosive materials, their velocity of detonation (VOD) and the distance they will travel in 24 and 36 microseconds. VOD Distance (inches) Traveled in Explosive Fps 24.mu.sec 36.mu.sec Ammonium Nitrate 8,100 2.33 3.50 ANFO 10,700 3.08 4.62 C4 27,500 7.92 11.88 C-4 26,500 7.63 11.45 Dynamite (Straight 60%) 18,500 5.33 7.99 Nitroglycerine 26,500 7.63 11.45 PETN 27,500 7.92 11.88 Sources: Hydrogen—"The Rate of Explosion in Gases," H. B. Dixon, 1893; ANFO—http://www.globalsecurity.org/military/systems/munitions/explosives-anfo.htm; other explosives—http://www.docstoc.com/docs/26842885/VoD-of-Various-Energetic-Materials/

A/D CONVERTER A multi-channel A/D converter converts the voltage signals from a plurality of sensors to digital signals, which, in the preferred embodiment, are then sent to a computer. The number of sensors could, in some applications, exceed 100, and each sensor requires its own dedicated channel. Consequently, it may be necessary to employ a plurality of converters. Each A/D converter should be capable of sampling its channels simultaneously at a sampling rate of about 800,000 samples per second or better. A 16-bit data channel provides adequate capacity.

COMPUTER The computer must be capable of accepting all of the sensor information from the A/D converter, process it and determine whether and when the CED detonators are to be ignited. The Intel Core i7-980X Extreme Edition microprocessor, with its six physical cores, is believed to have sufficient processing capacity for the current application when employed with matched computer components that are also commercially available. In the preferred embodiment, two microprocessors are employed: one microprocessor sequentially evaluates each of the sensors at a high processing rate, while the second microprocessor is dedicated to processing only data from those sensors showing levels above some predetermined threshold.

The second microprocessor employs an algorithm that determines which, if any, detonators are to be ignited and when they are to be ignited. If it is determined that one or more subsystems of the VPS are to be detonated, the computer sends out two signals to each subsystem that is to respond by setting off counter-explosions. The first signal triggers the ignition module that ignites the EBW detonator in the EBW safety switch, and the second signal, slightly delayed, signals the fire control unit to trigger the firing module. As with the other components of the VPS, the computer must be able to operate reliably in a hostile environment.

Figure 9:
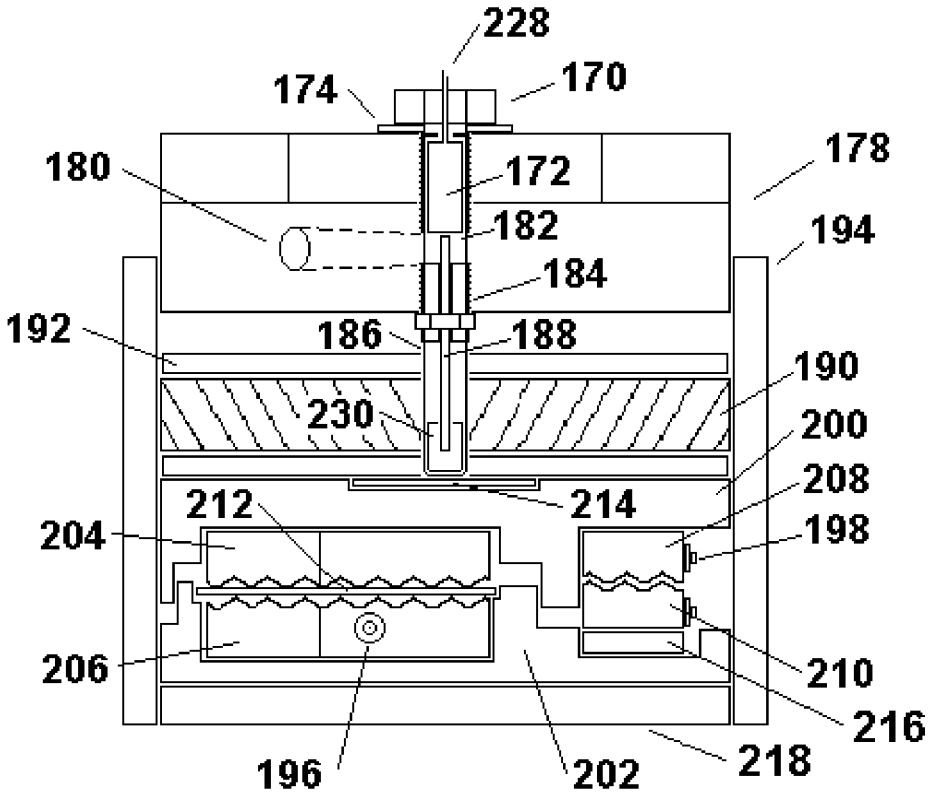
Figure 9:
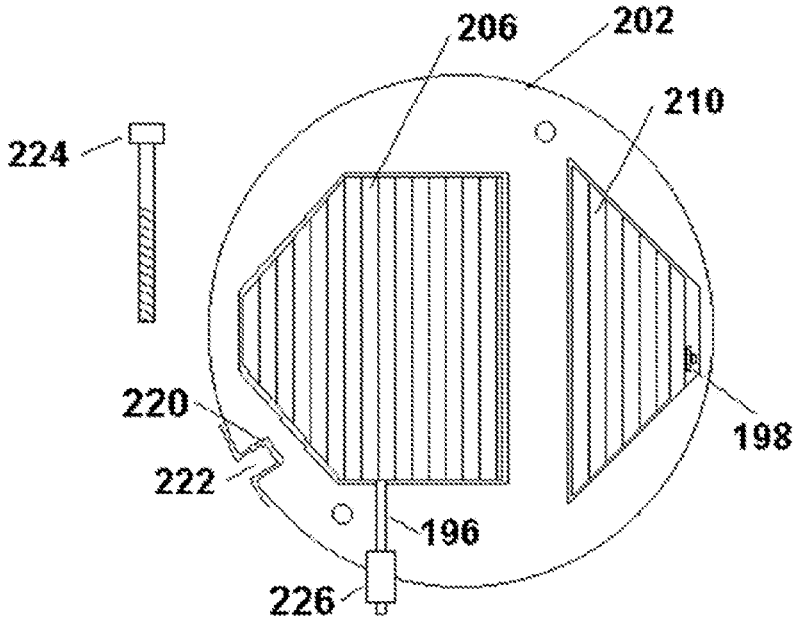
Figure 9:
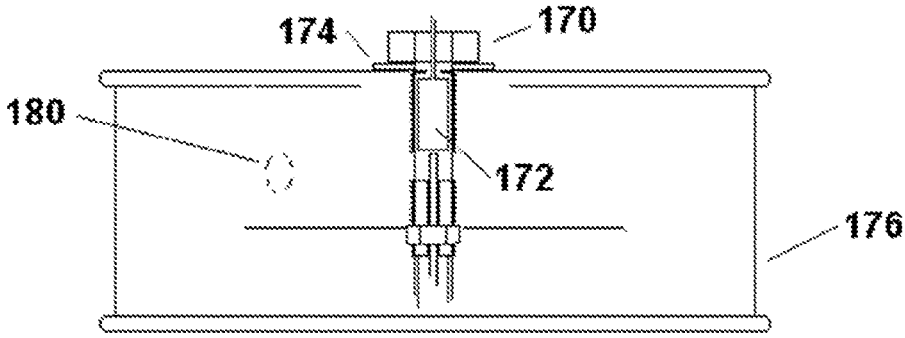

FIRE CONTROL UNIT & FIRING MODULE The fire control unit and its remote firing module are commercially available; a plurality of either or both may be required in any given VPS application. In the preferred embodiment, the fire control unit consists of a battery supply, a battery charging unit and circuitry with a triggered spark gap for rapid (less than five microseconds) firing. The output energy from the firing module is a 4000-volt pulse with 1500 amperes peak current. Its one-microfarad capacitor must attain at least 3500 volts before firing is initiated. Once the capacitor has been charged, a 30-volt pulse from the fire control unit provides the triggering of the triggered spark gap that enables the capacitor to release sufficient energy to ignite an EBW detonator. DETONATORS Commercially available, general-purpose EBW detonators meet the requirements of the current application to detonate a high-explosive charge. SAFETY SWITCH FIG. 9 is a front cross-sectional view of the EBW safety switch that is interposed between the firing module and the CED, and which is part of the current invention. A detonator holder (170) can be fabricated from a high-strength steel cap screw that is bored out from the bottom to hold the EBW detonator (172). The detonator leads (228) project from a small hole through the cap screw's top and are connected to the ignition module (111 in FIG. 3). At least one exhaust port (180) provides a vent for the detonator gases. The detonator holder is screwed into a threaded hole in the center of the cylinder head (178), which is also the securable top of the switch housing (194), as well as the upper chamber of the switch. A cylinder sleeve (184), threaded on the outside, is screwed into a threaded hole in the bottom center of the cylinder head. Within the combustion chamber (182), the top of the piston (188) is in contact with or very close to the bottom of the detonator. In this embodiment, the piston, for minimal inertial resistance, is made from titanium rod one-eighth inch in diameter. The inside of the cylinder sleeve and the wall of the piston are sized and polished to minimize the clearance between them. However, the cylinder should offer minimal resistance when the piston slides inside it. A flexible piston boot (186) fits over the bottom of the piston and its threaded top screws onto the bottom of the cylinder sleeve, hermetically sealing the combustion chamber from the electrical compartment in the lower part of the switch. The piston boot is similar in construction to an elastomer switch-sealing boot. The lower end of the piston can slide inside a hole bored partially through the center of a PTFE piston cap (230), which fits inside the bottom of the boot; the outside of the boot is in direct contact with a steel annulus (214). The piston fits snugly between the detonator and the bottom of the hole in the PTFE piston cap. The piston and boot protrude through the center hole of a ceramic and steel insulator, which is a ceramic annulus (190) sandwiched between two steel annuli or plates (192) bonded to each side of it. The steel annuli protect the ceramic annulus from detonator impact, while the ceramic annulus prevents high heat from entering the lower switch compartment. The outside of the boot and the insulator are not in contact, but the clearance between them is minimal, thereby restricting the expansion of the boot when the EBW detonator is ignited. Below the shock/heat insulator is the electrical compartment.

In the preferred embodiment, the electrical compartment contains an upper contact holder (200), which holds the primary upper contact (204) and the secondary upper contact (208). Below the upper contact holder is the lower contact holder (202), which holds the primary lower contact (206) and the secondary lower contact (210). The primary contacts are for high voltage, while the secondary contacts carry only low voltage. A dielectric sheet or plate (212) is placed between the primary upper and lower contacts. The preferred material for this plate is glass with a high dielectric strength. A commercially available alkali glass 100.mu.m thick (0.004") can be expected to perform well.

Voids in the lower chamber are eliminated to the extent feasible to prevent electrical arcing and to inhibit the accumulation of hot gases. To prevent arcing between the high-voltage electrical components and the cylindrical switch housing: [0069] the upper and lower contact holders are constructed with overlapping PTFE segments that shield the high-voltage primary contacts from the switch housing and from the secondary contacts; [0070] the high-voltage terminals (196) pass through the center of cylindrical PTFE insulators (226) as they exit the switch housing, as shown in FIG. 9*b*. These terminals thread into the sides of the primary contacts; [0071] and the contacts fit into shallow wells that have been cut into the contact holders and are bonded in place. Hot glue appears to be an adequate bonding agent, although for a more secure and lasting bond, the Master Bond Polymer System Supreme 3HT or 11HT is recommended.

The upper and lower holders and contacts can be assembled prior to insertion into the switch housing. After placing the dielectric plate between the primary contacts, two nylon socket cap screws (224) are inserted through holes in the upper contact holder and threaded into holes in the lower contact holder; these are shown in FIG. 9*b*. The socket cap screws are finger-tightened just enough to remove any play between the dielectric plate and the contacts. This assembly can then be inserted through the bottom of the switch housing, aligning the keyway (220) in the contact assembly with the key (222) in the switch housing. The switch-housing base (218 in panel a) is removable from the switch housing to facilitate replacement of the dielectric plate after each use. The high-voltage terminals are inserted through holes in the switch housing and screwed into the sides of the primary contacts after the contact assembly has been inserted into the switch housing.

For the contact holders, high impact resistance, temperature resistance, dielectric strength and easy machinability are important qualities. Consequently, PTFE makes an excellent material. Aluminum is an excellent material for the contacts, because of its high electrical conductivity and machinability. After parallel ridges are cut into the faces of the contacts at equal distances apart, the two faces can be seated with valve-grinding compound or equivalent.

Since the secondary contacts (208, 210) carry low voltage, they can be close together without a dielectric plate. A piece of dense foam (216) is bonded to the bottom face of the lower secondary contact and to the bottom of a shallow well cut into the lower contact holder (202). The wires leading from the secondary contact terminals are fed from low-voltage terminals (198) out through a grommeted hole in the switch casing.

Finally, FIG. 9*c* shows the installation of the blast shield (176). It is mounted onto the cylinder head and tightened in place with the detonator holder (170) and a steel washer (174). The blast shield is preferably constructed from steel and is of sufficient strength to withstand the venting of the detonator gases through the exhaust port(s) (180).

COMPUTER MONITORING SYSTEM The VPS has at least six subsystems to protect a vehicle: one subsystem for each of the four vehicle sides plus one subsystem for each of the vehicle's V underbody panels, shown in FIG. 6. The frame/chassis CEDs shown in FIG. 7 and the lifting CEDs can be integrated with these other subsystems.

Figure 10A:
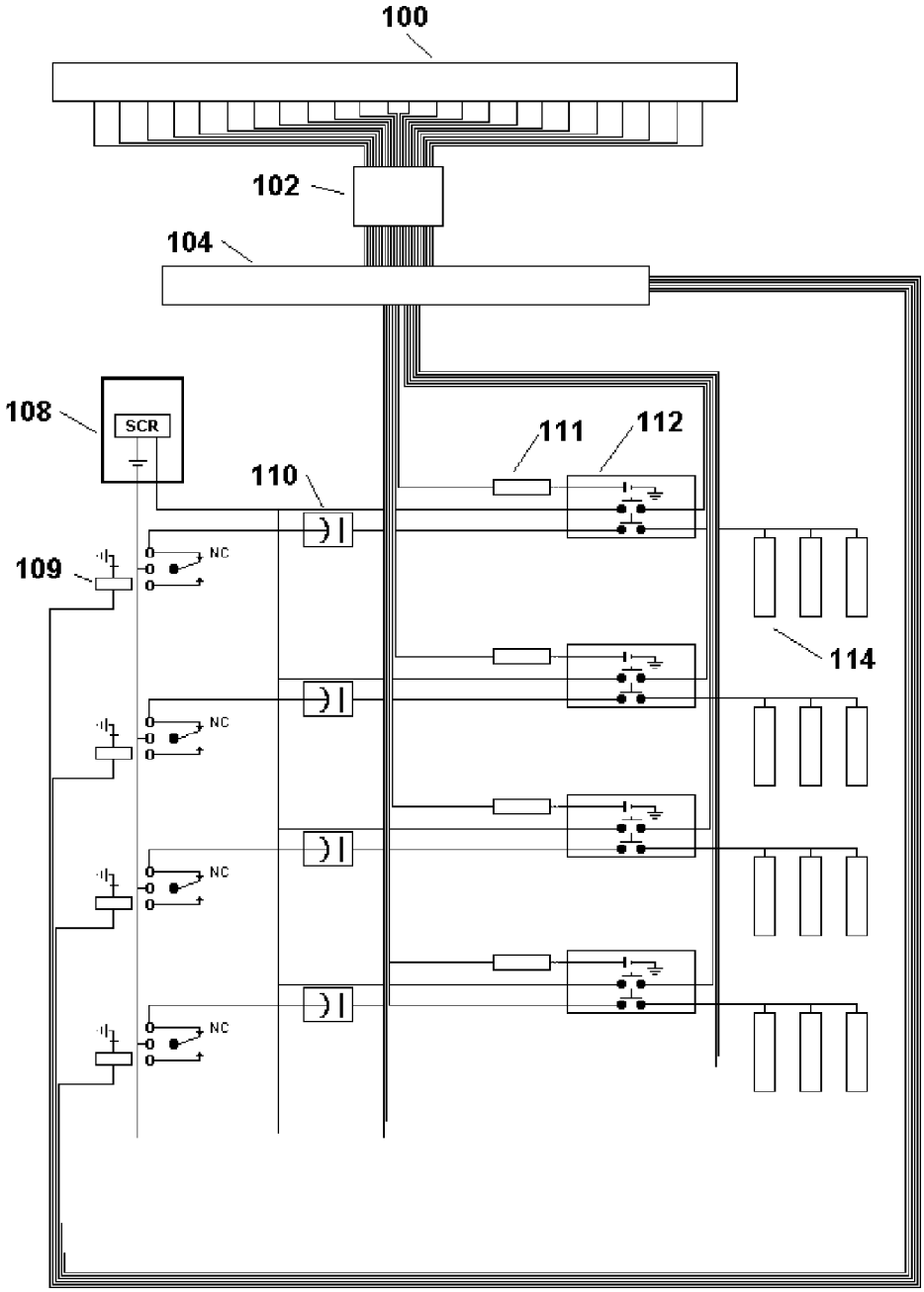

A schematic diagram of the main components of a Vehicle Protective System in the preferred embodiment is shown in FIG. 10*a*, which is similar to the version shown earlier in FIG. 3, except expanded to show some of the subsystems. All of the components in this system have already been described, except for the solid-state microsecond relay (109). This relay is capable of handling the trigger from the fire control unit (108) that triggers the spark gap in the firing module (110). The relays permit only those firing modules selected by the computer to be ignited by the control module.

Operation—FIGS. 2, 3, 9-12

When the VPS is turned on (see FIG. 3), a plurality of sensors (100) strategically mounted on the protected vehicle begins continuously polling the environment. Upon the initiation of an IED attack, one or more photodiodes detect the attack in its earliest stages as anomalous values of light intensity and/or frequency. A multi-channel A/D converter (102) samples the data from each photodiode at a rate of at least 800,000 samples per second. There is one dedicated channel for each sensor. The converter digitizes all of the data and streams it to the first processing means of a computer (104). The computer is looking for signals that exceed a predetermined light-intensity level and fall within a frequency range that is characteristic of a high-explosive explosion.

Figure 11:
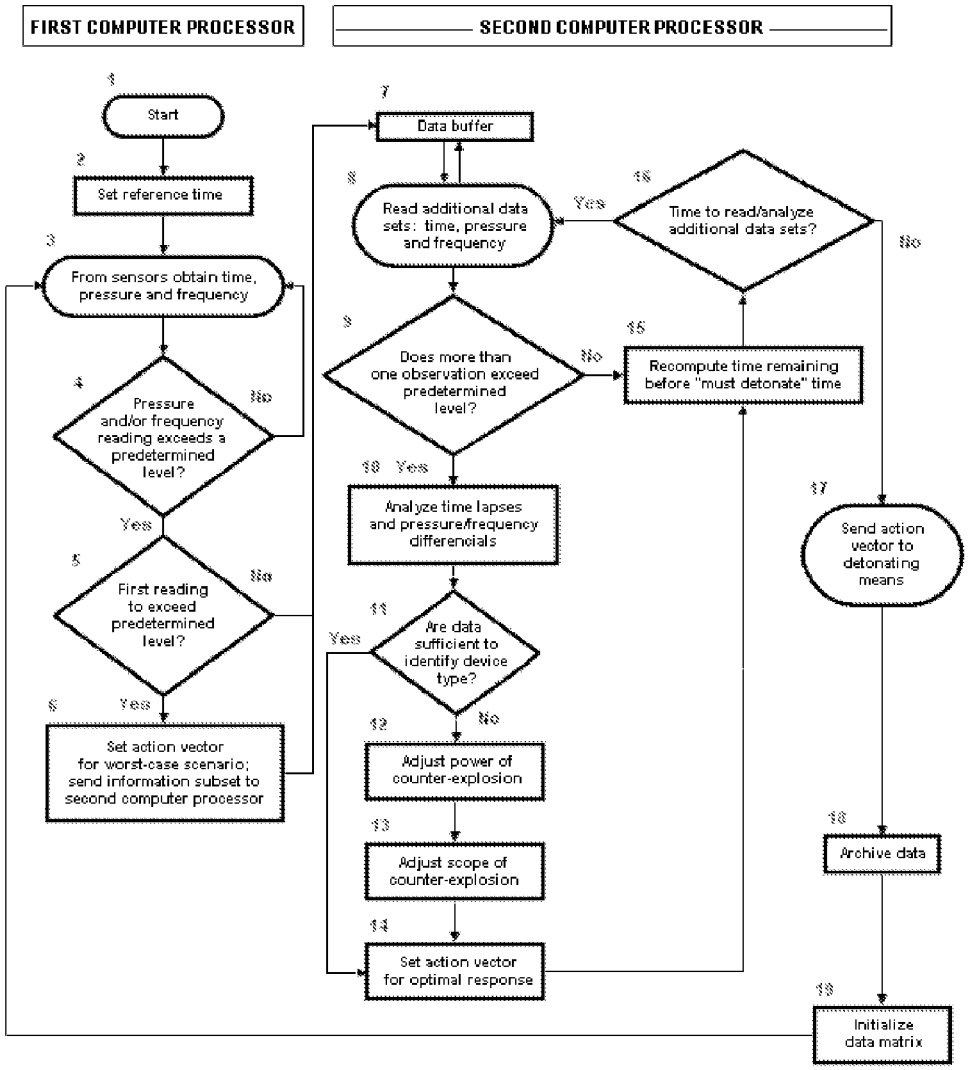

A flow diagram of the computer process is shown in FIG. 11. Once the process starts (step 1) and a reference time is established (step 2), the sensing means collect and transmit data about the attack, such as light intensity, pressure and frequency readings (step 3). The time of each reading is also recorded. If the data are from photodiodes, the light intensity/frequency data are compared to a predetermined threshold level indicative of an IED attack; if the data are from pressure sensors, the pressure/frequency readings are compared to predetermined threshold values of pressure and frequency. If no predetermined threshold level is exceeded, the next set of data is evaluated. This process continues until a data set is encountered that exceeds the threshold level (step 4). If this is the first set that exceeds the threshold level (step 5), the computer sets the action vector to the worst-case scenario (step 6), which means that all of the CEDs associated with that sensor are marked for detonation, except that one or more CEDs may be reserved for backup protection. The action vector can be viewed as a vector of zeros and ones, with each binary value associated with one and only one subsystem. A one indicates the subsystem is to be activated in preparation for detonation; a zero, that it is not to be activated.

In step 6, after the action vector has been set, the data set is sent to the second processing means for rapid evaluation—a time-saving feature—and the data set for this first observation is stored (step 7) in a data matrix in the data buffer. This is a matrix containing each non-trivial light intensity/pressure/frequency reading and the time at which the reading was taken. In step 8, the second processing means now assumes responsibility for collecting data from all sensors with above-threshold readings, as designated by the first processing means, and storing them in the data buffer. Meanwhile, the first processing means continues to sequentially monitor and test all of the remaining sensors.

When the second processing means receives the data set from the first processing means, the requirement in step 9 (at least two observations completed) is not yet satisfied, so in step 15 the time remaining before the CEDs must be detonated is computed. In step 16 a decision is made whether sufficient time remains to read and evaluate additional sensor readings. If the time remaining is insufficient, signals corresponding to the action vector are sent by the computer in step 17 to the detonating means, which, in this case (only one observation), will protect against the worst-case scenario by causing all subsystems with a one in the corresponding action vector to ignite. Otherwise, the second processing means determines the maximum number of additional sensor data sets that can be read and processed before the "must detonate" time occurs. Meanwhile, the first processing means may have added data sets from additional sensors to the data matrix in the data buffer. In step 7, the second processing means reads newer data sets from the sensors already in the data matrix.

Assuming there are now at least two observations (step 9) for at least one sensor, the data matrix is reanalyzed in step 10, based on the light intensity/pressure/frequency differentials for each sensor and the elapsed time between these readings. Data from any other sensors that may now be recording above-threshold values are also added to the analysis. Different types of explosive devices have different characteristic signatures. These signatures are defined by the pattern of light intensities, pressures and frequencies at the specific locations of the sensors; and they are further defined by changes in these light intensity/pressure/frequency patterns over time. Once these patterns have been established for these various known types of explosive devices and included in the VPS database, it may be possible to quickly identify the location, power and scope of an external explosion after only a minimal amount of data have been collected and analyzed.

Drawing on this database of patterns associated with different explosive-device types, the second processing means in step 11 determines whether a) the current pattern appears to conform with a recognizable pattern, in which case it jumps to step 14 to reset the action vector without further analysis; or b) the worst-case scenario can be revised in light of the new observations: namely, in step 12, whether the total power required from the counter-explosion can be scaled down, and/or in step 13 whether the scope of the counter-explosion can be reduced. If at least one of these conditions is true, then the action vector is revised accordingly (step 14). The process then continues to recycle with step 15. An IED attack generally will not be confirmed until at least one pressure sensor has recorded the arrival of a shockwave.

Once the computer (104) confirms that an attack is underway and is ready with its planned response, it first signals the ignition modules (111 in FIG. 10*a*) that are to respond, which ignite the EBW detonators in the corresponding EBW safety switches (112), causing their detonators to ignite and the contacts in these switches to close. At the same time, the computer opens all of the normally closed solid-state relays (109) that are not involved in the response, leaving the remaining relay(s) closed. Each relay is on the pathway to one VPS subsystem. With the switch contacts of the selected EBW switches now closed, current passes from the low-voltage secondary contacts to the fire control unit (108), which then sends out a 30-volt trigger to the relays. The trigger passes through those relays that are still closed and on to their firing modules (110), which fire a high-voltage pulse through the primary contacts in the still-closed safety switches, igniting the EBW detonators (114) in the selected CEDs.

The components of the EBW safety switch were shown in FIG. 9. When an IED attack is detected and the computer signals the ignition module to close the EBW safety switch, the EBW detonator (172) mounted in the cylinder head (178) is ignited. The detonator has a breakout time of just three microseconds. The detonation sends a shockwave through the combustion chamber (182) and drives down the piston (188), which was already in close proximity or in contact with the detonator. The piston boot (186) around the piston confines the detonator gases to the combustion chamber. One or more exhaust ports (180) allow the rapidly expanding gases from the detonator to be vented. A ceramic and steel insulator (190, 192) prevents most of the heat from entering the lower chamber of the switch. The force from the detonator drives down the piston (188), the piston cap (230) and the piston boot (186) against a steel annulus (214), depressing the upper contact holder (200). First, the secondary contact plates (208, 210) make contact, allowing the signal from the computer to pass through to the fire control unit. At the same time, the computer sends a signal to open the relays (109) whose subsystems will not be involved in the counter-attack. An instant later, the ridged and aligned surfaces of the primary upper (204) and lower (206) contact plates crush the dielectric plate of glass (212) between them. After a measured delay—just long enough to ensure that the primary contacts are in contact—the fire control unit (108) sends a pulse through the relays and to the EBW switch, where it passes through one high-voltage terminal (196), through the primary contacts and out the other high-voltage terminal. The exhaust port(s) are sized to ensure that the gases in the combustion chamber remain pressurized and keep the primary contacts together for the few microseconds required to fire the control module.

The normally open EBW safety switch is interposed between the firing module and the CED detonators to prevent transient voltages in and around the highly charged firing module from accidentally firing the CED detonators. Without the safety switch, these transients have the potential to ignite the CED detonators and set off the main charges. This hazard is of special concern if the system is installed in a moving vehicle, and especially if the vehicle is traversing through rough and dusty terrain. Unless at least one sensor detects an IED attack underway, the primary switch contacts remain separated by the dielectric plate, thereby preventing any transient high-voltage charges from passing through the switch and prematurely igniting the main-charge (CED) detonator. Prior to the current invention, the risk was too high to allow these firing units to be armed in moving vehicles.

When the CED detonators receive the high-voltage pulse from the firing module, they ignite, creating a shockwave and intense heat, both of which are required to trigger the high-explosive material (116), shown in the CED assembly in FIG. 2. When the explosives are set off, the rapidly expanding gases within the containment vessel (118) shear the shear pins (162), and blow the cap (164) off the CED. As the explosion progresses, the recoil from the explosion drives the piston (154) in the CED assembly against the air pocket (158), compressing the air and absorbing much of the recoil energy. The oil rings (156) minimize the escape of air between the piston and the cylinder sleeve (152). The CED assembly has to be recharged and refurbished before it can be reused, unless disposable units are used to reduce weight.

For vehicles equipped with radar, a protective system against incoming projectiles, such as rocket-propelled grenades (RPGs), also can employ the VPS. The flow diagram shown in FIG. 11 can be adapted. The primary differences are that in the case of projectiles: a) the location and velocity of the incoming projectile are continuously monitored instead of the light intensity/pressure/frequency from an explosion; and b) the counter-explosions may not be simultaneous because an earlier explosion may be required to cause the incoming projectile to detonate prematurely, while a slightly delayed explosion may be required to repel the shrapnel from the exploding projectile.

Figure 12:
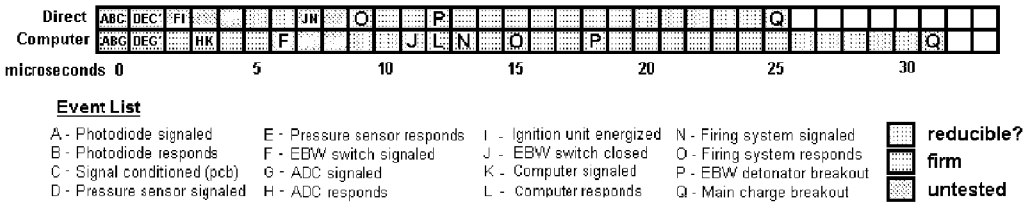

Table 2 below shows the major components of the VPS, a vendor for each component and the response time of each vendor's product, as used in the preferred embodiment. (Disclosure: the inventor and his wife own Research Enterprises, Inc.) FIG. 12 shows the response sequence and times for major components of the Vehicle Protective System for two different embodiments: direct and with a computer. Total response times in both embodiments are under 32 microseconds.

Key components of the VPS, vendors and response times Component Vendor Response Time Piezoelectric Sensor PCB Piezotronics, Inc 1.mu.sec Photodiode Hamamatsu 0.3 nsec A/D Converter General Standards Corp. 1.2.mu.sec Core i7-980X Extreme Edition processor Intel Corporation MIPS Relay Electronic Design & Research Inc. 20 nsec Control Unit Teledyne RISI, Inc 3.mu.sec Firing module Teledyne RISI, Inc Signal Conditioner—1.mu.sec EBW Safety Switch Research Enterprises, Inc. 6.mu.sec CED, incl. C-4/EBW detonator Research Enterprises, Inc. 15.5.mu.sec A major opportunity for reducing response time lies with the main-charge breakout time, which, for an 1134-gram (2.5 lbs), 102 mm (4") diameter charge of C-4, consumes 12.5.mu.sec, including detonator break-out time. A 1995 study ("High-speed, High-Resolution Observations of Shaped-Charge Jets Undergoing Particulation," Winer et al., UCRL-JC-118383) reports that a 427-gram, 65 mm diameter charge of LX-14 (95.5% HMX) completed main-charge breakout in just 5.82.mu.sec. This suggests that two smaller charges, each with a detonator, could save five or so microseconds, which could reduce the amount of vehicle elevation needed to obtain adequate response time.

Other Embodiments

While the above description contains many specificities, these should not be construed as limitations on the scope of the invention, but as exemplifications of the presently preferred embodiments thereof. Many other ramifications and variations are possible within the teachings of the invention. Examples are provided below. Thus the scope of the invention should be determined by the appended claims and their legal equivalents, and not by the examples given.

Regarding the CED assemblies shown in FIGS. 1 and 2, further embodiments include:

CED containment (118) vessels that are asymmetric about their center axis to control the dispersion of the blast particles and shockwave; [0093] the cylinder sleeve (152) and CED canister (150) are of separate construction, and the cylinder sleeve fits tightly into the canister; [0094] an explosive other than C-4 is used in the CED; [0095] the piston (154) and containment vessel (118) are of separate construction, and the bottom surface of the piston is fitted to the outer contour of the closed end of the containment vessel (118); [0096] the threaded bolt (146) that screws into the access hole (166) is of separate construction with the shear pin (162); [0097] the open end of the containment vessel has no shrapnel (168); [0098] the open end [0099] of the containment vessel is flared like a horn to further control the dispersion of the explosion; the explosive charges in the CEDs are insulated from heat, since with sufficient heat and shock originating from CEDs nearby, there is a risk that the charges could spontaneously detonate.

Figure 13:
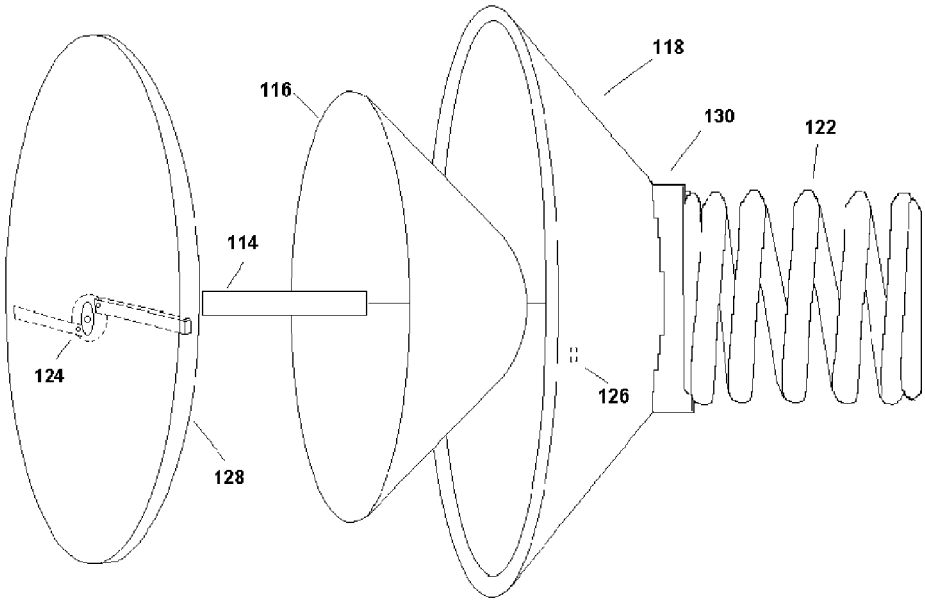
Figure 13:
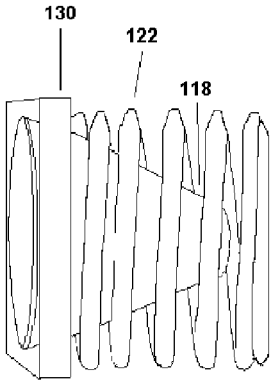
Figure 14:
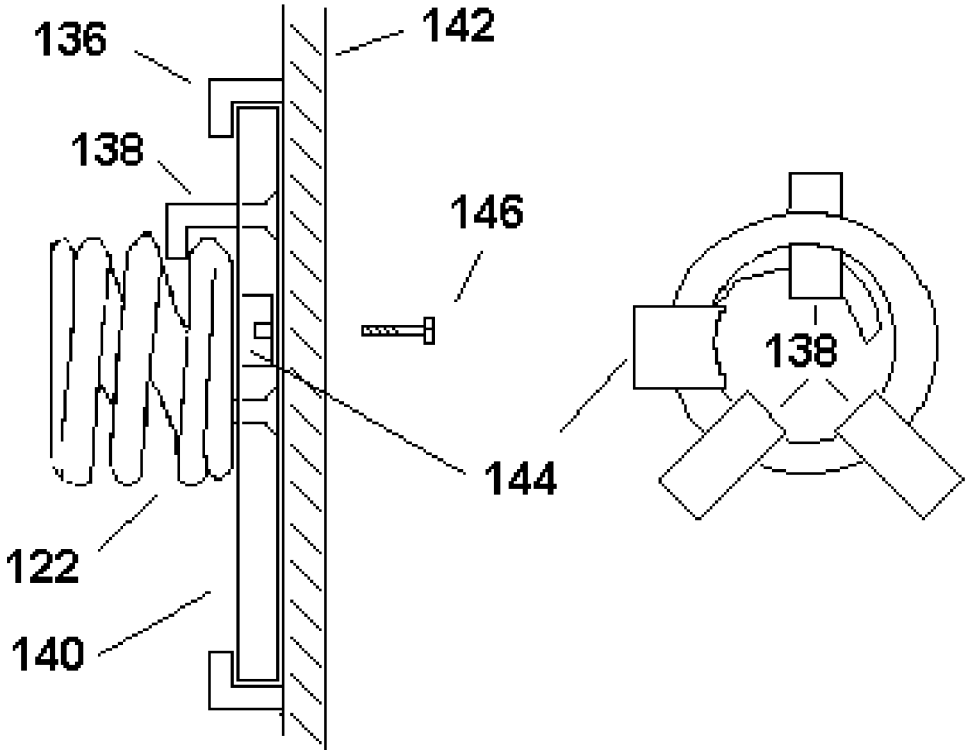

With reference to FIG. 13 showing other embodiments of a CED: [0101] in panel (a), a CED is fitted with a shock-absorbing device, which is a closed-end coil compression spring (122) rated to absorb the recoil force of the counter-explosion. One end of the coil spring abuts a collar (130) near the closed end of the containment vessel cone; [0102] a metal cap (128) fits into the open end of the containment vessel and secures the materials inside. The cap incorporates a keyed locking mechanism (124) whose arms project into openings, recesses or slots (126) fabricated into the sides of the containment vessel; [0103] in panel (b), one end of a coil spring (122) abuts a collar (130) around the open end of a containment vessel (118); the collar is recessed to receive it, facilitating a smaller containment vessel with a smaller charge. The other end of the coil spring is mounted to a vehicle surface by means of a bracket. [0104] a double-collar or two separate collars are fabricated onto the cone to accommodate both an inner and outer coil spring. This allows a greater recoil force to be absorbed without increasing the external dimensions of the CED; [0105] the containment vessel (118) and collar (130) may be of unitary construction;

With reference to FIG. 14, showing an embodiment for mounting a CED on a surface: [0107] one end of the coil-spring shock absorber is mounted via a bracket onto the external surface of the vehicle. Three right-angled lugs (138) are installed on a metal plate (140), which can slide into a bracket (136) affixed to the surface of a vehicle (142) and secured. The lugs project out from the plate. The mounting end of the coil spring (122) has a smaller diameter than the main section of the coil. To mount the CED, the coil spring is inserted between the three lugs and twisted (clockwise) until it is firmly in place. A pressure clamp (144) installed on the plate holds the coil spring firmly in place with a single machine bolt inserted from the interior of the vehicle. Retrofitting CEDs to existing vehicles is simplified by welding or otherwise affixing a pair of vertical, right-angled brackets to the surface of the vehicle into which one can readily slide and secure the mounting plate with its CED. The main advantage of this embodiment is that it enables vehicles to be retrofitted with the VPS relatively quickly and at relatively low cost. The disadvantage is that the units protrude from the vehicle, unless mounted underneath the vehicle.

In further embodiments of the radial housing shown in FIG. 4: [0109] the housing for photodiodes comprises a single layer of diode compartments; [0110] a mechanism is attached for cleaning the outer surfaces of the glass lenses of the photodiode compartments so that the light intensity readings will be sufficiently accurate. The mechanism can be a water dispersion device positioned in front of and above the compartment lenses, whereby pressurized water can be dispensed through jets in the mechanism. Tubing to convey the water from a water reservoir is routed to the dispersion device. Optionally, after the water has been applied, pressurized air can be directed through the same jets onto the lenses to dry them, as necessary. A test light can be directed at one or more photodiodes periodically to ensure that the photodiodes are operating effectively; otherwise, the cleaning system is automatically turned on for a timed duration.

In further embodiments of the CED arrays shown in FIG. 5: [0112] the CED containment vessels and the array housing are of unitary construction; [0113] various shock-absorber systems can be adapted to CED arrays. A smaller-diameter circular piston (154) can be used, though it may displace a longer air pocket (158) than the CED shown in FIG. 2; [0114] a CED array is mounted on a plurality of spring-loaded T-tracks. The underside of the array has channels that fit over and attach to the T-tracks; the channels are positioned between the CEDs.

In further embodiments of the CED arrays shown in FIG. 8: [0116] a detection system using no pressure sensors, the advantage being cost-savings;

a detection system using no photodiodes; [0117] a detection system using sensors that are sensitive to infrared radiation; [0118] a detection system that collects and interprets real-time images from an unfolding explosion. The location, size, scope and velocity of the explosion can be evaluated from dynamic patterns evolving with respect to the location, size and intensity of the brightest image appearing on one or more screen monitors or other sensing device; [0119] a detection system using LIDAR (light detection and ranging); [0120] a normally open, pressure-sensitive mechanical switch mounted on a railing or other device that is connected directly to the CED detonators and that projects sufficiently from the vehicle to provide adequate response time. The shockwave trips the switch, triggering a high-voltage pulse from a capacitor, which goes through an EBW safety switch and then to the CED detonators.

Figure 10B:
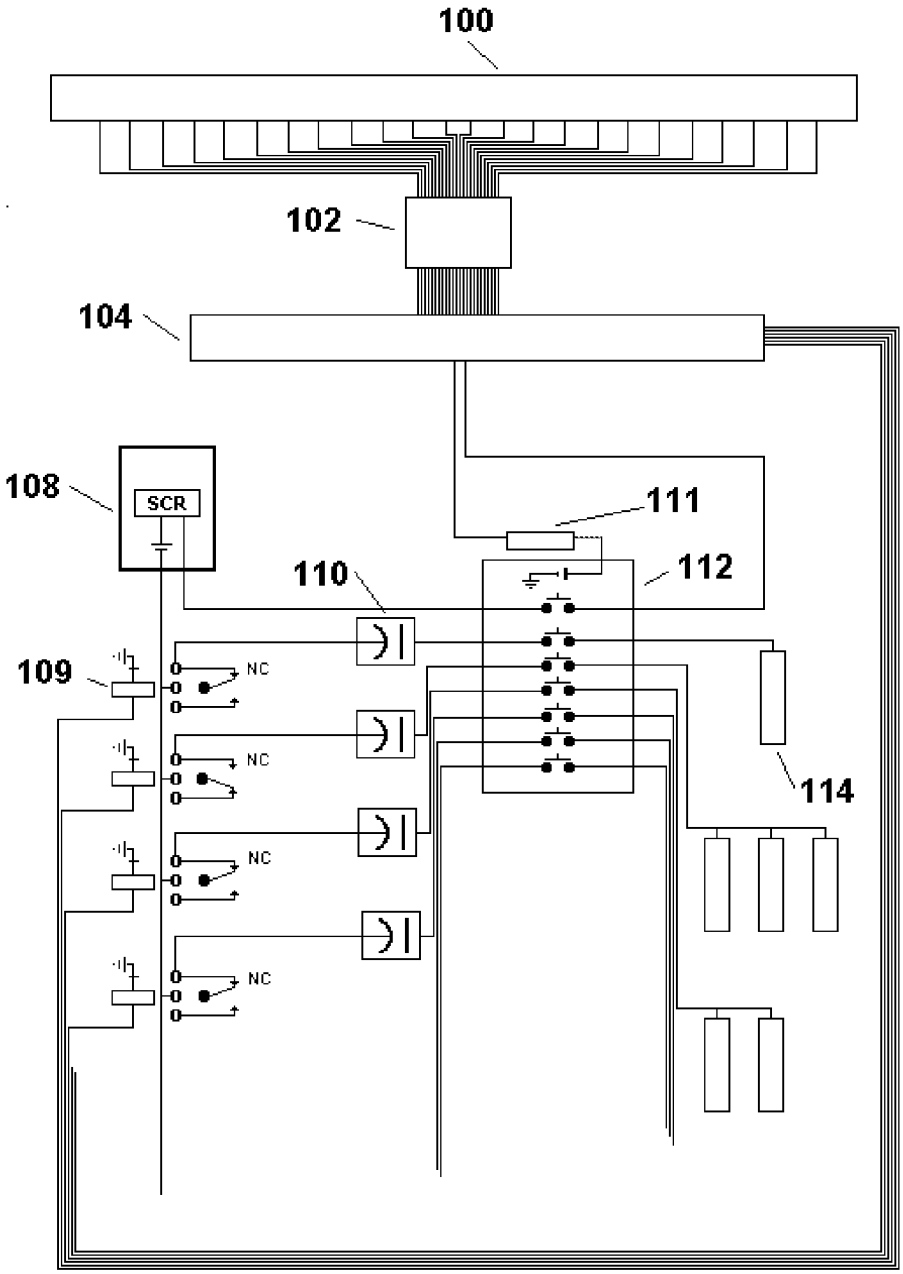

In further embodiments of the computer schematic shown in FIG. 10*a: [*0122] only a partial set of CEDs within each subsystem is detonated, leaving a reserve should another attack occur on the same subsystem before the spent CEDs can be replaced or recharged. In this variation, a second relay switch is interposed between the first relay switch (109) and the firing module (110). If subsystem (a) is set off, the computer automatically switches the second relay to prepare to fire subsystem (b), the backup subsystem. Subsystem (b) also will have its dedicated ignition module and EBW safety switch;

In another embodiment, instead of being able to activate only subsystems of CEDs, the VPS is reconfigured so that the computer can activate individual or small groups of CEDs to provide a totally optimized response to any IED attack that it confirms. A subsystem with this configuration is shown in FIG. 10*b*, which also shows an EBW safety switch with multiple, independent high-voltage circuits. In this embodiment, a multiplicity of CEDs can be installed at a variety of locations, especially on the front, back and sides of a vehicle, with each individual CED having its own relay and firing module. These CEDs can have containment vessels with a variety of tapers and explosive capacities. As an example, IED attacks in close proximity to the side of a vehicle would elicit a response from CEDs having wide tapers and large capacities. For attacks originating farther away and releasing comparable energy, CEDs with narrower tapers and smaller capacities would be preferred. If the computer can accurately determine the characteristics of an attack, it can select for detonation that subset of CEDs that will best disrupt the shockwave and deflect the shrapnel, and it can also time the individual detonations to have the greatest impact. This embodiment is also well-suited to best exploit the database of known types of IEDs for a more rapid and effective response, whereby different device types call for different responses.

The reason the above-described embodiment is not the preferred embodiment is that the cost and weight of the extra components may well exceed the benefit from improved operational efficiency, given its infrequency of use on any given vehicle. On the other hand, by responding with a reduced overall counter-explosion, the experience inside the attacked vehicle might be less stressful and risky for the vehicle occupants, thereby outweighing the extra cost.

Figure 15:
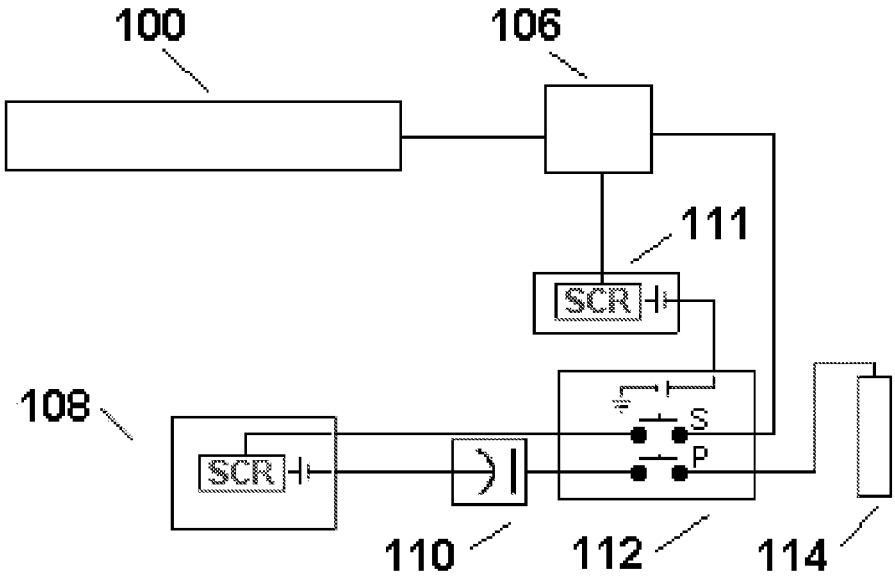

In further embodiments of the VPS schematic shown in FIG. 15: [0126] a computer is not utilized. As soon as a sensor (100) detects an IED attack, it sends a signal to a signal conditioner (106), which processes the input signal and emits two output signals. One signal goes to an ignition module (111) that ignites the detonator in the EBW switch (112), driving down its piston and closing the switch contacts. In FIG. 9*a*, the secondary upper (208) and lower (210) contact plates make contact with each other slightly before the primary contact plates (204, 206) are compressed together, allowing the signal conditioner's second signal to pass to the fire control unit (108) and signal that the high voltage can be released. When the fire control unit receives this signal, it triggers the triggered spark gap in the firing module (110), which discharges its capacitor, sending high voltage through the still-closed primary contacts and on to the CED detonator(s) (114), which are ignited. At least one exhaust port (180) in the cylinder head allows the spent detonator gases to escape at a rate sufficient to keep the primary switch contacts in the closed position long enough for the detonators to fire.

In further embodiments of the flow diagram shown in FIG. 11: [0128] given the very short response time in which to react to an external explosion, and to ensure that the response is always timely, a further embodiment of this invention relies on additional multi-tasking. It reduces the potential processing time by dividing the tasks to be performed by the protective system among several pairs of computer microprocessors. For example, in the case of a vehicle, the following three sets of CEDs and their associated sensors and detonators are each allocated to the following separate microprocessor pairs: a) CEDs installed on the side, front and back panels of a vehicle and the CED lifters; b) CEDs installed on the vehicle underbody; and c) CEDs installed on the vehicle frame/chassis and the CED lifters. Note that the CED lifters are potentially beneficial for attacks of both type a) and type c). [0129] data from the photodiodes and from the pressure sensors are handled initially by separate microprocessors and then combined in step 9.

In further embodiments of the EBW safety switch shown in FIG. 9: [0131] the cap to the EBW switch housing is fabricated separately from the cylinder head (178) [0132] the detonator holder (170) is integral with the cylinder head (178), and the blast shield (176) is mounted from the bottom of the switch housing base (218) [0133] the piston (188) in FIG. 9*a* has a diameter other than ⅛ inch; [0134] the piston is made from a material other than titanium; [0135] the top of the piston is flat to provide maximum downward force; [0136] the piston top is domed to deflect gases away from the interstice between the piston and the cylinder sleeve (184), thereby imposing less stress from expanding gases on the piston boot (186). [0137] materials other than PTFE are used to fabricate the upper and lower contact holders (200, 202). There are several other fluoropolymer and other elastomer candidates; these might work just as well or better. Each of the other components can be made from materials other than those specified in the preferred embodiment; [0138] instead of parallel ridges, the contacts (204, 206, 208, 210) have facing surfaces that are raised and pointed, like small, contiguous pyramids, and are positioned so that the upper and lower contact surfaces mesh when closing, thereby facilitating the crushing of the dielectric; [0139] in some applications, the secondary contacts are not required; [0140] certain components, such as the steel annulus (214), the piston boot (186), steel washer (174) and/or piston cap (230) may be non-critical parts and can be dispensed with.

In a further embodiment, slapper (or EFI) detonators are used instead of exploding bridgewire detonators; any detonator with a sufficiently fast breakout time is an option.

In further embodiments of the V-shaped underbody shield shown in FIG. 6: [0143] for existing vehicles, the chassis is raised by modifying the suspension system, using the equivalent of a truck-suspension lift kit; a V-shaped shield (310) is inserted underneath the chassis.

a single-CED array is positioned at each end of the armored CED array (326) along the base of the V, and these arrays face each other. They are attached with a bracket that will hold each array. These units provide additional protection to the armored CED array itself.

In applying the Surface Protective System to non-military uses, the user should be mindful of the risk of collateral damage to other property and persons. In further embodiments of the SPS: buildings can be protected with the current invention. The embodiment of this invention shown in FIG. 2—a recessed CED within a cylinder housing—is readily adaptable to new-building construction and usually can be retrofitted to existing buildings with conventional construction techniques. The unit can be attached to a structural member of the building by means of a simple bracket. In most cases, CEDs would be required only near ground level. An area at least one foot out from the building must be secured from unauthorized access. This is to secure the sensors that project from the building facade, which is necessary to provide sufficient response time for the counter-explosion. Other permanent installations that could benefit from the SPS are security stations at the entrance to military bases, other key points of entry and to military barracks. Risk of collateral damage can be a serious issue in all of these applications [0146] most bridges, which are particularly vulnerable to car bombs, can be protected with the current invention. A CED array such as that shown in FIG. 2 or a single CED unit similar to (314) in FIG. 6, with a mount similar to (318) could be attached near the base of each at-risk structural member. Suspension bridges would be more difficult to protect, although a special bracket that attaches to a cable could be adapted. As with buildings, it is necessary to deny unauthorized personnel close access to key bridge components. Risk of collateral damage can be a serious issue. [0147] While most modes of public ground transportation can be protected in the same way as military vehicles, the risk of collateral damage is particularly acute around boarding areas and areas where public transport vehicles are in close proximity with pedestrians and other vehicles.

Benefits from the Current Invention

When an IED has gone off and most other measures have failed—including detection, jamming, and intelligence—and when there are only microseconds left to save the military vehicle and its occupants, few other options remain. The fact that military lives continue to be lost in Afghanistan—and at an increasing rate—indicates that further improvements are still needed in protecting against IED attacks. The current invention, the Surface Protective System and its embodiments as the Vehicle Protective System, by attenuating the shockwave from the IED and repelling its shrapnel with a set of controlled directional counter-explosions, can offer many military crews a final hope that they will survive the IED attack and be ready for their next mission.

There are several other major benefits from the VPS technology. Less armor will be required to protect vehicles because their surfaces are now protected from a direct blast. This means that vehicles can be lighter, faster and more agile, which will also make them potentially more mission-capable. A lighter vehicle will also require less power, which allows for further weight-reduction.

While the VPS technology is not inexpensive, there are significant cost-savings from reduced armoring and powering requirements, which will offset the costs of the VPS. In addition to reducing acquisition costs, lighter vehicles will yield savings in fuel costs, as well as easing the logistics of transporting sufficient fuel to the battlefield. Moreover, the technology can be retrofitted to current vehicles. For vehicles that are equipped with radar, the VPS technology can also provide protection against rocket-propelled grenades (RPGs) and other missile-borne explosives. For example, the technology may provide a less expensive defense against Man-portable air-defense systems (MANPADS).

The VPS also has the potential to optimize the response to an external explosion, utilizing the computer-based algorithm that controls individual or small groups of counter-explosive devices (CEDs). This algorithm potentially reduces the number of CEDs that require detonation. As a result, there is: a) less wear and tear on the vehicle from the counter-blasts; b) less wear and tear on personnel within the vehicle from any violent motion and/or debilitating noise caused by the counter-blasts; c) an additional margin of safety because CEDs remain available should another attack occur before the spent CEDs can be replaced or recharged; and d) a reduction in the cost and effort to remove and replace spent CEDs because this method deploys the minimal response required to repel the attack.

Another benefit is that a vehicle disabled by an IED attack or other cause, provides its occupants with the means to fend off enemy attackers by selectively discharging CEDs against approaching threats. This can buy the occupants considerable time until assistance can arrive on the scene. There are also likely other situations when a VPS-equipped vehicle can use its CEDs as an offensive weapon against the enemy.

I claim:

1. A method for protecting a surface from an unexpected explosion, comprising:

a. providing at least one detection device for detecting environmental data;

b. processing said environmental data, comprising:

i. recording said environmental data;

ii. accessing said environmental data;

iii. analyzing said environmental data; and iv. determining whether said explosion represents a threat;

c. responding by detonating at least one counter-explosive device (CED) if it is determined that said explosion represents a threat; and d. providing a safety means, wherein said CED is prevented from detonating if no threat from an explosion has been determined, whereby any threat from an ongoing explosion is attenuated by detonating at least one CED, and all CEDs are prevented from detonating by said safety means if no explosion threat has been determined.

2. The method in claim 1 wherein said CED comprises:
a. providing a containment vessel comprising an open end and a closed end;
b. providing explosive material positioned inside said vessel at said closed end; and
c. providing a detonating device comprising a CED detonator for igniting said explosive material.

3. The method according to claim 2, wherein a CED array comprises providing a shallow-profile housing; at least one CED installed within said housing; and said housing mountable on a conformable surface, whereby blasts from said CED array are projected across said conformable surface.

4. The method according to claim 3, providing that said surfaces to be protected from unexpected explosions comprise exterior surfaces of a vehicle.

5. The method according to claim 4, wherein a double-CED array comprises providing two CED arrays positioned and combined back edge-to-back edge, angled and mounted to conform to the vertex of the two panels comprising a V-shaped vehicle underbody, whereby a counter-explosion from each said CED array projects across the exterior surface of the panel on which it is mounted.

6. The method in claim 2, further providing a shock-absorbing device to absorb explosion recoil from said CED.

7. The method according to claim 6, wherein said shock-absorbing device comprises providing:
a. a canister with an open end and a closed end;
b. said canister recessable, mounted and secured, such that said open end of said canister faces outward from the surface to be protected from an unexpected explosions;
c. said canister with an interior that is functional as a cylinder;
d. said canister containing a pocket of air between said closed end of said canister and the head of a piston slidable within said cylinder; and
e. said canister containing said CED, which is engaged with the bottom of said piston, with said open end of said CED projecting toward said open end of said canister, whereby when said CED is detonated, said CED urges said piston to compress air in said air pocket, thereby absorbing said recoil.

8. The method according to claim 2, wherein said safety means comprises providing an external ignition module; and a high-speed, normally open, electro-mechanical safety switch comprising:
a. a switch housing;
b. an upper chamber;
c. a piston;
d. a lower chamber;
e. a means for producing energy in said upper chamber; and
f. a means for transferring energy from said upper chamber to said lower chamber.

9. The method according to claim 8, wherein said upper chamber comprises providing: a combustion chamber; a cylinder; and at least one vent for venting combustion products.

10. The method according to claim 9, wherein said means for producing energy in said upper combustion chamber of said safety-switch is a safety-switch detonator, and the means for transferring said energy from said upper chamber to said lower chamber is said piston.

11. The method according to claim 10, wherein said piston comprises providing a rod, slidable within said cylinder, whose upper end is exposed to said safety-switch detonator, and whose lower end extends into said lower chamber.

12. The method according to claim 10, wherein said lower chamber comprises providing:
a. an electrical contact assembly comprising: an upper contact holder holding an upper contact, and a lower contact holder holding a lower contact; and a shatterable dielectric plate disposed between said upper contact and said lower contact; and
b. two high-voltage terminals, one said terminal connecting a high-voltage source to one of said upper or lower contacts, and the other said terminal connecting other said contact to said CED detonator, whereby when said safety-switch detonator causes said piston to compress said contacts, said dielectric plate is shattered, and high-voltage current flows through first said high-voltage terminal, through said contacts and out second said high-voltage terminal, causing said CED detonator to ignite.

13. The method according to claim 12, wherein said lower chamber comprises providing a plurality of pairs of high-voltage terminals, contact pairs and dielectric plates, whereby a subset of a plurality of CEDs can be selectively ignited.

14. The method according to claim 12, further providing:
a partition between said upper chamber and said lower chamber, comprising a ceramic insulator sandwiched between and bonded to upper and lower protective impact plates,
whereby said partition largely protects said lower chamber from heat and shock originating in said combustion chamber.

15. The method according to claim 12, wherein said safety means comprises providing said external ignition module, which ignites said safety-switch detonator, urging said piston to compress said pair of upper and lower contact holders, and shattering said dielectric plate, whereby high-voltage current flows through first said high-voltage terminal, through said contacts and out second said high-voltage terminal.

16. The method according to claim 12, further providing for at least one pair of primary contacts and one pair of secondary contacts, said primary contacts providing for the flow of high-voltage current, and said secondary contacts providing for the flow of low-voltage current, said low-voltage current flowing through said secondary contacts and signaling a fire control unit that said primary contacts are in a closed state, whereby said fire control unit can cause a high-voltage electrical pulse to ignite said CED detonator.

17. The method in claim 1, wherein said detection device is selected from among the group consisting of pressure-sensing device, frequency-sensing device, light-sensing device, real-time imaging device, heat-sensing device, LIDAR device, RADAR device, and timing device; and one or more detection devices may be selected.

18. The method according to claim 1, further determining which of at least one CED detonator is to be ignited by at least one firing module, and the time at which said firing module is to ignite at least one said CED detonator to protect a surface, comprising providing:
a. a first processor and a second processor; a cache capable of receiving data, and_shared by both processors for data exchange; and a memory that is in communication with said processors, capable of storing program code executable by said processors, and able to communicate with a memory controller that can access and communicate with at least one external device;
b. said first processor to monitor real-time primary data, and to deposit in said cache data exceeding predetermined threshold values; and c. said second processor to access said cache, and to execute said program code to process said data deposited into said cache, performing the following steps:

Step 1: setting instruction set for "worst case" response;

Step 2: calculating the time remaining before "must detonate" time;

Step 3: if insufficient time remains to acquire and analyze additional data, communicating said instruction set to said external device to initiate CED response;

Step 4: if sufficient time remains, acquiring and analyzing additional data;

Step 5: revising said instruction set for optimal CED response; and

Step 6: returning to step 2, whereby said external device initiates said CED response according to said instruction set.

19. The method according to claim 18, wherein said real-time primary data comprises data sensed by at least one sensor and at least one timer.

20. The method as claimed in claim 18, further providing a second database comprising the explosion characteristics of known explosive devices, whereby said explosion characteristics can be compared with the characteristics of the current explosion to facilitate the rapid identification of the current explosive device, thereby potentially facilitating a rapid and optimized said CED response.

* * * * *